US010482823B2

(12) United States Patent
Lee et al.

(10) Patent No.: US 10,482,823 B2
(45) Date of Patent: Nov. 19, 2019

(54) LIGHT EMITTING DISPLAY DEVICE

(71) Applicant: Samsung Display Co., Ltd., Yongin-si, Gyeonggi-do (KR)

(72) Inventors: Wonjun Lee, Hwaseong-si (KR); Gichang Lee, Seoul (KR); Cholho Kim, Suwon-si (KR); Gunwoo Yang, Seoul (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 15/852,773

(22) Filed: Dec. 22, 2017

(65) Prior Publication Data

US 2018/0182301 A1 Jun. 28, 2018

(30) Foreign Application Priority Data

Dec. 27, 2016 (KR) ..... 10-2016-0180241

(51) Int. Cl.
*G09G 3/3266* (2016.01)
*G09G 3/3291* (2016.01)
(Continued)

(52) U.S. Cl.
CPC ..... *G09G 3/3266* (2013.01); *G09G 3/2003* (2013.01); *G09G 3/3233* (2013.01); *G09G 3/3291* (2013.01); *G09G 2300/0426* (2013.01); *G09G 2300/0814* (2013.01); *G09G 2300/0866* (2013.01); *G09G 2310/0245* (2013.01); *G09G 2310/0251* (2013.01); *G09G 2310/063* (2013.01); *G09G 2320/0219* (2013.01); *G09G 2320/0271* (2013.01); *G09G 2330/021* (2013.01); *G09G 2330/028* (2013.01)

(58) Field of Classification Search
CPC ..... G09G 2320/0219
See application file for complete search history.

(56) References Cited

U.S. PATENT DOCUMENTS 7,903,057 B2 3/2011 Uchino et al.
8,624,880 B2 * 1/2014 Ishiguro ..... G09G 3/3233 345/204

(Continued)

FOREIGN PATENT DOCUMENTS

KR 10-2016-0010772 1/2016
KR 10-2016-0110846 9/2016

*Primary Examiner* — William Boddie
*Assistant Examiner* — Bipin Gyawali
(74) *Attorney, Agent, or Firm* — Lewis Roca Rothgerber Christie LLP

(57) ABSTRACT

A light emitting display device includes: a first switch connected between a data line and a first node and including a gate connected to a first scan line; a second switch connected between a first driving power line and a second node and including a gate electrode connected to the first node; a first capacitor connected between the first node and the second node; a light emitting element connected between the second node and a second driving power line; a scan driver applying a first A-scan signal and a first B-scan signal during different times to the first scan line; a data driver applying a first initialization signal and a data signal to the data line at different times; and a power supply portion applying a first driving voltage, a second driving voltage, and a third driving voltage to the first driving power line at different times.

17 Claims, 19 Drawing Sheets

(51) Int. Cl.
*G09G 3/20* (2006.01)
*G09G 3/3233* (2016.01)

(56) References Cited

U.S. PATENT DOCUMENTS

| | | | | |
|---|---|---|---|---|
| 8,654,158 | B2 | 2/2014 | Tsai et al. | |
| 8,786,542 | B2 * | 7/2014 | Morimoto | G09G 3/20 345/103 |
| 8,982,017 | B2 * | 3/2015 | Lee | G09G 3/3225 345/76 |
| 9,111,486 | B2 * | 8/2015 | Choi | G09G 3/3225 |
| 9,646,532 | B2 * | 5/2017 | Onoyama | G09G 3/3233 |
| 9,886,910 | B2 * | 2/2018 | Wu | G09G 3/3233 |
| 9,972,245 | B2 * | 5/2018 | Wang | G09G 3/3233 |
| 10,032,408 | B2 * | 7/2018 | Kang | H01L 27/3262 |
| 2008/0238328 | A1 * | 10/2008 | Shin | G09G 3/2022 315/169.3 |
| 2010/0321422 | A1 * | 12/2010 | Ishiguro | G09G 3/3233 345/698 |
| 2014/0125717 | A1 | 5/2014 | Uchino et al. | |
| 2016/0020174 | A1 | 1/2016 | Kim | |
| 2016/0267844 | A1 | 9/2016 | Senda et al. | |
| 2017/0132980 | A1 * | 5/2017 | Wu | G09G 3/3233 |
| 2018/0158414 | A1 * | 6/2018 | Lee | G09G 3/3258 |
| 2019/0019452 | A1 * | 1/2019 | Zhu | G09G 3/3233 |

* cited by examiner

LIGHT EMITTING DISPLAY DEVICE

CROSS-REFERENCE TO RELATED APPLICATION

This application claims priority to and the benefit of Korean Patent Application No. 10-2016-0180241, filed on Dec. 27, 2016, in the Korean Intellectual Property Office (KIPO), the disclosure of which is incorporated by reference herein in its entirety.

1. TECHNICAL FIELD

Embodiments of the present invention relate to a light emitting display device, and more particularly, to a light emitting display device capable of realizing high resolution.

2. DESCRIPTION OF THE RELATED ART

In a light emitting display device, each pixel includes a light emitting element and a pixel circuit for driving the light emitting element.

The pixel circuit includes a plurality of switches. The plurality of switches are connected to a plurality of signal lines.

Accordingly, a high-resolution light emitting device including a large number of pixels requires a relatively larger number of signal lines.

In the case where there are a relatively large number of signal lines, an interval between the signal lines may not be properly maintained and signal interference may occur.

It is to be understood that this background of the technology section is intended to provide useful background for understanding the technology and as such disclosed herein, the technology background section may include ideas, concepts or recognitions that were not part of what was known or appreciated by those skilled in the pertinent art prior to a corresponding effective filing date of subject matter disclosed herein.

SUMMARY

Embodiments of the present invention may be directed to a light emitting display device capable of realizing high resolution.

According to an example embodiment, a light emitting display device includes: a first switch including a gate electrode connected to a first scan line, the first switch connected between a data line and a first node; a second switch including a gate electrode connected to the first node, the second switch connected between a first driving power line and a second node; a first capacitor connected between the first node and the second node; a light emitting element connected between the second node and a second driving power line; a scan driver applying a first A-scan signal to the first scan line in at least a part of a first period, a second period, a third period, a fourth period, a fifth period, a sixth period and a seventh period, and applying a first B-scan signal to the first scan line in a part of the fifth period; a data driver applying a first initialization signal to the data line in at least a part of the first, second and third periods, and applying a data signal to the data line in a part of the fifth period; and a power supply portion applying a first driving voltage to the first driving power line in at least a part of the second period, applying a second driving voltage, which is greater than the first driving voltage, to the first driving power line in at least a part of the third, fourth, fifth and sixth periods, and applying a third driving voltage, which is greater than the second driving voltage, to the first driving power line in at least a part of the first period and at least a part of the seventh period.

The first A-scan signal may have an active voltage in the first, second and third periods, and the first B-scan signal may have an active voltage in one horizontal period of the fifth period.

The light emitting display device may further include a second scan line adjacent to the first scan line. The scan driver may further apply a second A-scan signal and a second B-scan signal to the second scan line. The scan driver may apply the first B-scan signal to the first scan line in at least a part of the first, second and third periods and apply the first B-scan signal to the second scan line in at least a part of the fifth period.

The first A-scan signal and the second A-scan signal may have an active voltage in the first, second and third periods, the first B-scan signal may have an active voltage in a first horizontal period of the fifth period, and the second B-scan signal may have an active voltage in a second horizontal period of the fifth period.

A positive edge time point of the first A-scan signal may be substantially equal to a positive edge time point of the second A-scan signal, and a negative edge time point of the first A-scan signal may be substantially equal to a negative edge time point of the second A-scan signal.

The first A-scan signal and the second A-scan signal may have a substantially equal pulse width.

A positive edge time point of the first B-scan signal may be ahead of a positive edge time point of the second B-scan signal, and a negative edge time point of the first B-scan signal may be ahead of a negative edge time point of the second B-scan signal.

The first B-scan signal and the second B-scan signal may have a substantially equal pulse width.

The first switch may include at least two switches connected in series between the data line and the first node.

The light emitting display device may further include a second capacitor connected between the second node and the second driving power line.

The light emitting display device may further include a third switch including a gate electrode to which a control signal is applied, the third switch connected between the second node and an initialization line to which a second initialization signal is applied.

The second initialization signal may be applied from the power supply portion.

The control signal may have an active voltage in at least a part of the first period.

The second initialization signal and the first initialization signal may have a substantially equal voltage.

The power supply portion may apply a second driving power signal to the second driving power line.

The second driving power signal may be less than or equal to the first driving voltage.

The data driver may further apply a first initialization signal to the data line in at least a part of the seventh period.

The foregoing is illustrative only and is not intended to be in any way limiting. In addition to the illustrative aspects, example embodiments and features described above, further aspects, example embodiments and features will become apparent by reference to the drawings and the following detailed description.

BRIEF DESCRIPTION OF THE DRAWINGS

A more complete appreciation of the present invention will become more apparent by describing in detail embodiments thereof with reference to the accompanying drawings, wherein.

DETAILED DESCRIPTION

Figure 1:
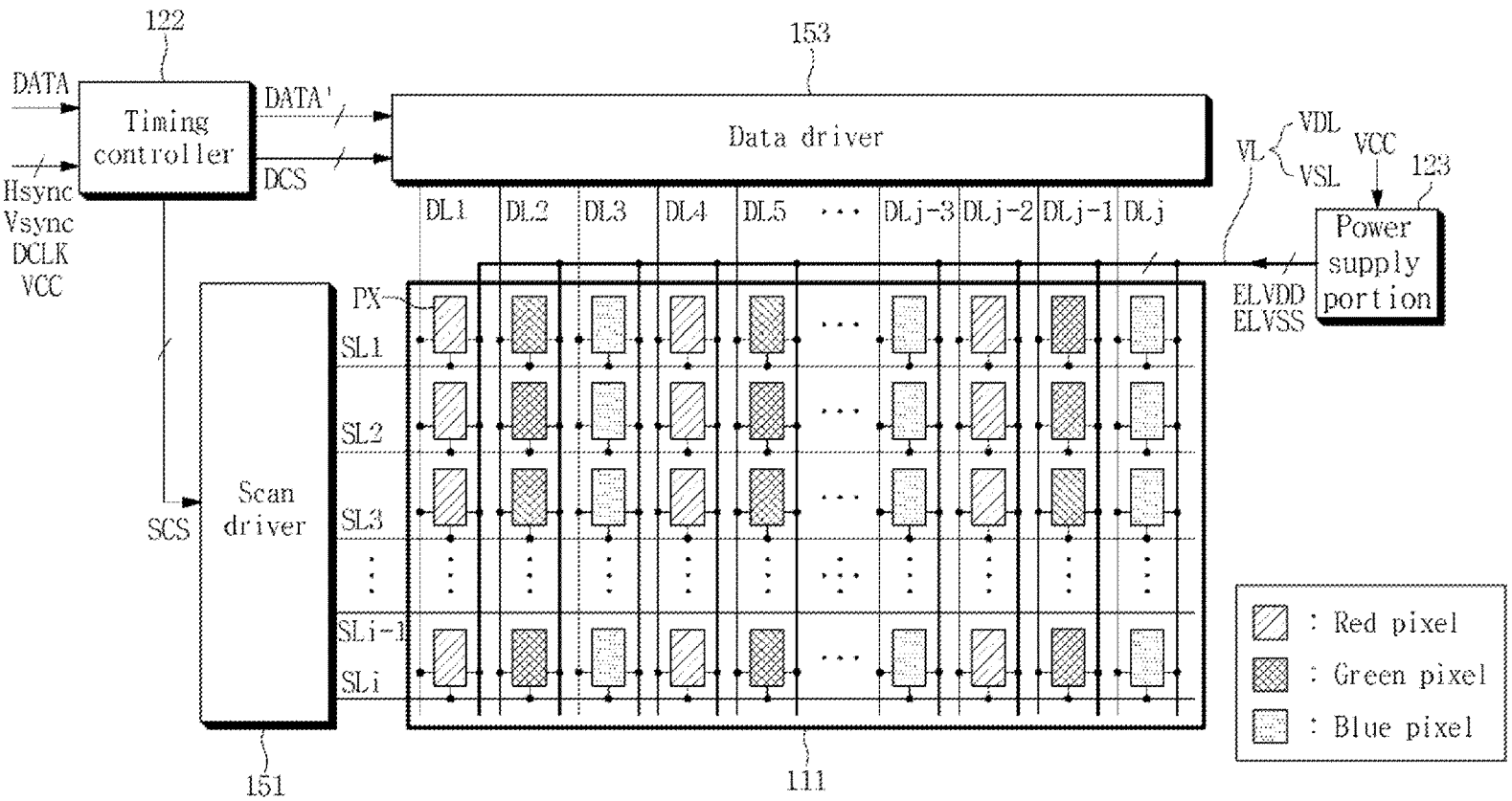
FIG. 1 is a view illustrating a light emitting display device according to an embodiment of the present invention.

Hereinafter, example embodiments will be described in more detail with reference to the accompanying drawings, in which like reference numbers refer to like elements throughout. The present invention, however, may be embodied in various different forms, and should not be construed as being limited to only the illustrated embodiments herein. Rather, these embodiments are provided as examples so that this disclosure will be thorough and complete, and will fully convey the aspects and features of the present invention to those skilled in the art. Accordingly, processes, elements, and techniques that are not necessary to those having ordinary skill in the art for a complete understanding of the aspects and features of the present invention may not be described. Unless otherwise noted, like reference numerals denote like elements throughout the attached drawings and the written description, and thus, descriptions thereof will not be repeated. In the drawings, the relative sizes of elements, layers, and regions may be exaggerated for clarity.

In the drawings, thicknesses of a plurality of layers and areas are illustrated in an enlarged manner for clarity and ease of description thereof. When a layer, area, or plate is referred to as being "on" another layer, area, or plate, it may be directly on the other layer, area, or plate, or intervening layers, areas, or plates may be present therebetween. Conversely, when a layer, area, or plate is referred to as being "directly on" another layer, area, or plate, intervening layers, areas, or plates may be absent therebetween. Further when a layer, area, or plate is referred to as being "below" another layer, area, or plate, it may be directly below the other layer, area, or plate, or intervening layers, areas, or plates may be present therebetween. Conversely, when a layer, area, or plate is referred to as being "directly below" another layer, area, or plate, intervening layers, areas, or plates may be absent therebetween.

Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

As used herein, the term "substantially," "about," and similar terms are used as terms of approximation and not as terms of degree, and are intended to account for the inherent deviations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

The electronic or electric devices and/or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

Some of the parts which are not associated with the description may not be provided in order to specifically describe embodiments of the present invention and like reference numerals refer to like elements throughout the specification.

Hereinafter, a light emitting display device according to an embodiment will be described with reference to FIGS. 1 to 14.

FIG. 1 is a view illustrating a light emitting display device according to an embodiment of the present invention.

A light emitting display device according to an embodiment includes a display panel 111, a scan driver 151, a data driver 153, a timing controller 122 and a power supply portion 123, as illustrated in FIG. 1.

The display panel 111 includes a plurality of pixels PX; and a plurality of scan lines SL1 to SLi, a plurality of data lines DL1 to DLj and a power supply line VL for transmitting various signals required for the pixels PX to display images, where i is a natural number greater than 2 and j is a natural number greater than 3. The power supply line VL includes a first driving power line VDL and a second driving power line VSL which are electrically separated from each other.

The pixels PX are arranged at the display panel 111 in a matrix form. The pixels PX include a red pixel for displaying red, a green pixel for displaying green and a blue pixel for displaying blue.

In another embodiment, the display panel 111 may further include a white pixel for displaying white images.

In another embodiment, the display panel 111 may be configured with a subsampled sub-pixel layout such as a PenTile® (Pentile® is a registered trademark of Samsung Display Company) or an RGBG configuration.

A system located outside the display panel 111 outputs a vertical synchronization signal, a horizontal synchronization signal, a clock signal and image data through an interface circuit by using a low voltage differential signaling (LVDS) transmitter of a graphic controller. The vertical synchronization signal, the horizontal synchronization signal and the clock signal output from the system are applied to the timing controller 122. In addition, the image data sequentially output from the system are applied to the timing controller 122.

The timing controller 122 generates a data control signal DCS and a scan control signal SCS based on the horizontal synchronization signal, the vertical synchronization signal and the clock signal input to the timing controller 122. The timing controller 122 outputs the data control signal DCS to the data driver 153 and the scan control signal SCS to the scan driver 151

In multiple embodiments, the data control signal DCS includes a dot clock, a source shift clock, a source enable signal and a polarity inversion signal.

In multiple embodiments, the scan control signal SCS includes a gate start pulse, a gate shift clock and a gate output enable.

In multiple embodiments, the data driver 153 samples image data signals DATA according to the data control signal DCS from the timing controller 122, latches the sampled image data signals corresponding to one horizontal line in each horizontal time (1H, 2H, . . . ), and applies the latched image data signals to the data lines DL1 to DLj. For example, the data driver 153 converts the image data signal DATA applied from the timing controller 122 into an analog signal using a gamma voltage input from the power supply portion 123, and applies the analog signals to the data lines DL1 to DLj. In addition, the data driver 153 generates an initialization signal and a dummy signal and applies them to the data lines DL1 to DLj.

In multiple embodiments, the scan driver 151 includes a shift register for generating scan signals in response to the gate start pulse SCS applied from the timing controller 122 and a level shifter for shifting the scan signals for the scan signals to have a voltage level suitable for driving the pixel PX. The scan driver 151 applies first to i-th scan signals to the scan lines SL1 to SLi, respectively, in response to the scan control signal SCS applied from the timing controller 122.

Each scan signal includes an A-scan signal and a B-scan signal. In such an embodiment, "i" number of A-scan signals are concurrently (e.g. substantially simultaneously) applied to the "i" number of scan lines SL1 to SLi, and "i" number of B-scan signals are sequentially applied to the "i" number of scan lines SL1 to SLi. For example, a first A-scan signal and a first B-scan signal are applied to a first scan line SL1, a second A-scan signal and a second B-scan signal are applied to a second scan line SL2, . . . , and an i-th A-scan signal and an i-th B-scan signal are applied to an i-th scan line SLi.

In multiple embodiments, the power supply portion 123 generates the gamma voltage, a first driving signal ELVDD and a second driving signal ELVSS. The power supply portion 123 applies the first driving signal ELVDD to the first driving power line VDL and the second driving signal ELVSS to the second driving power line VS L.

Figure 2:
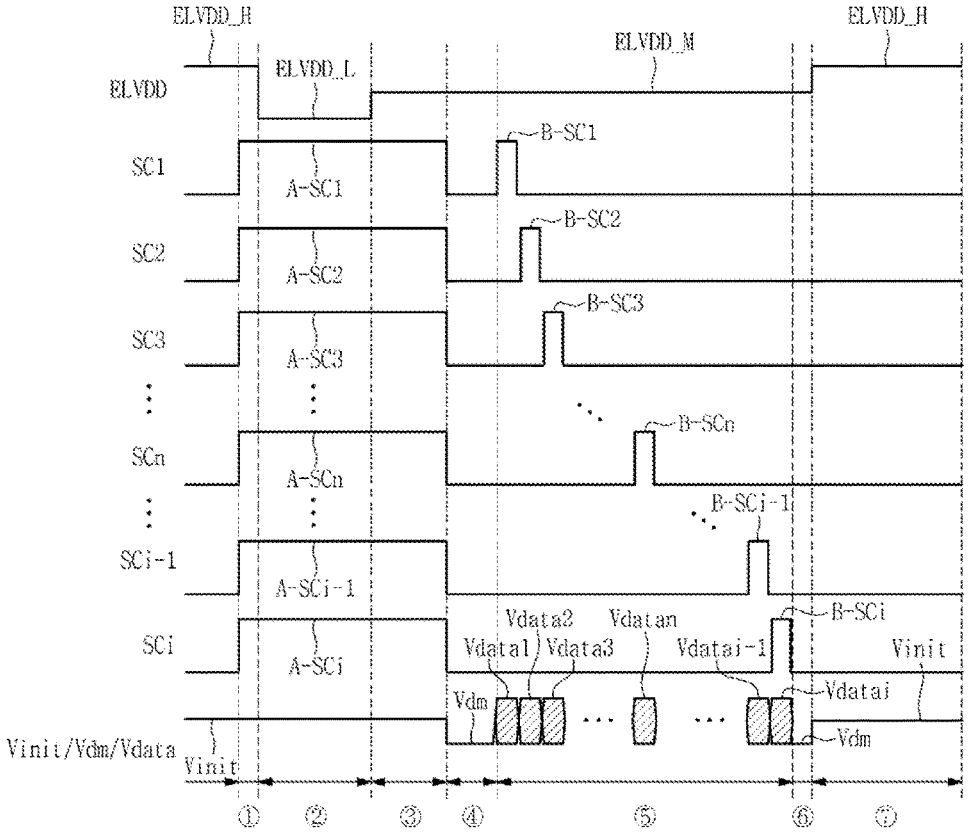
FIG. 2 is a diagram illustrating waveforms of scan signals applied to respective scan lines, initialization signals and data signals applied to an m-th data line and a first drive signal applied to a first driving power line in FIG. 1.

FIG. 2 is a diagram illustrating waveforms of the scan signals applied to the respective scan lines, the initialization signal and the data signals applied to an m-th data line and the first drive signal applied to the first driving power line VDL in FIG. 1.

In multiple embodiments, each of the scan signals SC1 to SCi is a pulse-shaped signal having an active voltage and an inactive voltage. In such an embodiment, the active voltage has a magnitude that may turn on a switches (e.g. transistors, such as Field-Effect Transistors (FET), and other switching elements) to be described below and the inactive voltage has a magnitude that may turn off the switch. For example, the active voltage of each of the scan signals SC1 to SCi may be about 8 V and the inactive voltage of each of the scan signals SC1 to SCi may be about −8 V.

In FIG. 2, in multiple embodiments, a high voltage of each of the scan signals SC1 to SCi corresponds to the active voltage. In addition, a low voltage of each of the scan signals SC1 to SCi corresponds to the inactive voltage. In another example embodiment, although not illustrated, the high voltage of each of the scan signals SC1 to SCi may be the inactive voltage and the low voltage of each of the scan signals SC1 to SCi may be the active voltage.

A first scan signal SC1 is applied to the first scan line SL1, a second scan signal SC2 is applied to the second scan line SL2, . . . , an n-th scan signal SCn is applied to an n-th scan line SLn, . . . , an (i−1)-th scan signal SCi−1 is applied to an (i−1)-th scan line SLi−1, and an i-th scan signal SCi is applied to the i-th scan line SLi.

Each of the scan signals SC1 to SCi may have an active voltage or an inactive voltage in at least a part of first, second, third, fourth, fifth, sixth and seventh periods ①, ②, ③, ④, ⑤, ⑥ and ⑦.

In multiple embodiments, each of the scan signals SC1 to SCi includes an A-scan signal (hereinafter, "a concurrent or simultaneous scan signal") and a B-scan signal (hereinafter, "a sequential scan signal"). For example, the first scan signal SC1 includes a first concurrent scan signal A-SC1 and a first sequential scan signal B-SC1.

In multiple embodiments, concurrent scan signals A-SC1 to A-SCi are applied to the scan lines SL1 to SLi, respectively, in at least a part of the first, second and third periods ①, ② and ③. For example, a first concurrent scan signal A-SC1 is applied to the first scan line SL1 in the first, second and third periods ①, ② and ③, a second concurrent scan signal A-SC2 is applied to the second scan line SL2 in the first, second and third periods ①, ② and ③, a third concurrent scan signal A-SC3 is applied to the third scan line SL3 in the first, second and third periods ①, ② and ③, . . . , an n-th concurrent scan signal A-SCn is applied to the n-th scan line SLn in the first, second and third periods ①, ② and ③, . . . , an (i−1)-th concurrent scan signal A-SCi−1 is applied to the (i−1)-th scan line SLi−1 in the first, second and third periods ①, ② and ③, and an i-th concurrent scan signal A-SCi is applied to the i-th scan line SLi in the first, second and third periods ①, ② and ③.

In multiple embodiments, each of the concurrent scan signals A-SC1 to A-SCi has the active voltage in at least a part of the first, second and third periods ①, ② and ③. For example, the first concurrent scan signal A-SC1 maintains the active voltage in the first, second and third periods ①, ② and ③, the second concurrent scan signal A-SC2 maintains the active voltage in the first, second and third periods ①, ② and ③, the third concurrent scan signal A-SC3 maintains the active voltage in the first, second and third periods ①, ② and ③, . . . , the n-th concurrent scan signal A-SCn maintains the active voltage in the first, second and third periods ①, ② and ③, . . . , the (i−1)-th concurrent scan signal A-SCi−1 maintains the active voltage in the first, second and third periods ①, ② and ③, and the i-th concurrent scan signal A-SCi maintains the active voltage in the first, second and third periods ①, ② and ③.

In multiple embodiments, the respective pulse widths of the concurrent scan signals A-SC1 to A-SCi are substantially equal to each other. For example, a pulse width of the first concurrent scan signal A-SC1 is substantially equal to a pulse width of the second concurrent scan signal A-SC2.

Respective positive edge time points of the concurrent scan signals A-SC1 to A-SCi are substantially equal to each other (e.g., substantially coincide with each other). For example, a positive edge time point of the first concurrent scan signal A-SC1 is substantially equal to a positive edge time point of the second concurrent scan signal A-SC2.

In multiple embodiments, respective negative edge time points of the concurrent scan signals A-SC1 to A-SCi are substantially equal to each other (e.g., substantially coincide with each other). For example, a negative edge time point of the first concurrent scan signal A-SC1 is substantially equal to a negative edge time point of the second concurrent scan signal A-SC2.

In this example embodiment, the positive edge time point of the concurrent scan signal means a time point when the concurrent scan signal transitions from the inactive voltage to the active voltage, and the negative edge time point of the concurrent scan signal means a time point when the concurrent scan signal transitions from the active voltage to the inactive voltage. For example, each of the concurrent scan signals transitions from the inactive voltage to the active voltage at a start time point of the first period ①, and transitions from the active voltage to the inactive voltage at an end time point of the third period ③. As such, because each of the concurrent scan signals A-SC1 to A-SCi is output concurrently (e.g. substantially simultaneously) and maintains the active voltage for a substantially equal time, the entire pixels are initialized concurrently in the first period ① and the second period ②. In addition, threshold voltages are detected concurrently from the entire pixels in the third period ③.

In multiple embodiments, each of the concurrent scan signals A-SC1 to A-SCi may maintain the inactive voltage for remaining periods except the first period ①, the second period ② and the third period ③ described above.

In multiple embodiments, the sequential scan signals B-SC1 to B-SCi are sequentially applied to the respective scan lines SL1 to SLi in a partial period of the fifth period ⑤ In other words, the fifth period ⑤ includes a plurality of horizontal periods, and the sequential scan signals B-SC1 to B-SCi are applied to the respective scan lines SL1 to SLi in each corresponding horizontal period of the fifth period ⑤. For example, a first sequential scan signal B-SC1 is applied to the first scan line SL1 in a first horizontal period of the fifth period ⑤, a second sequential scan signal B-SC2 is applied to the second scan line SL2 in a second horizontal period of the fifth period ⑤, a third sequential scan signal B-SC3 is applied to the third scan line SL3 in a third horizontal period of the fifth period ⑤, . . . , an n-th sequential scan signal B-SCn is applied to the n-th scan line SLn in an n-th horizontal period of the fifth period ⑤, . . . , an (i−1)-th sequential scan signal B-SCi−1 is applied to the (i−1)-th scan line SLi−1 in an (i−1)-th horizontal period of the fifth period ⑤, and an i-th sequential scan signal B-SCi−1 is applied to the i-th scan line SLi−1 in an i-th horizontal period of the fifth period ⑤.

Accordingly, each of the sequential scan signals B-SC1 to B-SCi may have the active voltage in a partial period of the fifth period ⑤. In other words, each of the sequential scan signals B-SC1 to B-SCi maintains the active voltage in each corresponding horizontal period of the fifth period ⑤. For example, the first sequential scan signal B-SC1 maintains the active voltage in the first horizontal period of the fifth period ⑤, the second sequential scan signal B-SC2 maintains the active voltage in the second horizontal period of the fifth period ⑤, the third sequential scan signal B-SC3 maintains the active voltage in the third horizontal period of the fifth period ⑤, . . . , the n-th sequential scan signal B-SCn maintains the active voltage in the n-th horizontal period of the fifth period ⑤, . . . , the (i−1)-th sequential scan signal B-SCi−1 maintains the active voltage in the (i−1)-th horizontal period of the fifth period ⑤, and the i-th sequential scan signal B-SCi maintains the active voltage in the i-th horizontal period of the fifth period ⑤.

In multiple embodiments, the respective pulse widths of the sequential scan signals B-SC1 to B-SCi are substantially equal to each other. For example, a pulse width of the first sequential scan signal B-SC1 is substantially equal to a pulse width of the second sequential scan signal B-SC2.

In multiple embodiments, the respective positive edge time points of the sequential scan signals B-SC1 to B-SCi are different from each other. For example, a positive edge time point of the first sequential scan signal B-SC1 is ahead of a positive edge time point of the second sequential scan signal B-SC2, the positive edge time point of the second sequential scan signal B-SC2 is ahead of a positive edge time point of the third sequential scan signal B-SC3, the positive edge time point of the third sequential scan signal B-SC3 is ahead of a positive edge time point of the fourth sequential scan signal B-SC4, . . . , a positive edge time point of the n-th sequential scan signal B-SCn is ahead of a positive edge time point of an (n+1)-th sequential scan signal B-SCn+1, . . . , a positive edge time point of an (i−2)-th sequential scan signal B-SCi−2 is ahead of a positive edge time point of the (i−1)-th sequential scan signal B-SCi−1, and the positive edge time point of the (i−1)-th sequential scan signal B-SCi−1 is ahead of a positive edge time point of the i-th sequential scan signal B-SCi.

In multiple embodiments, the respective negative edge time points of the sequential scan signals B-SC1 to B-SCi are different from each other. For example, a negative edge time point of the first sequential scan signal B-SC1 is ahead of a negative edge time point of the second sequential scan signal B-SC2, the negative edge time point of the second sequential scan signal B-SC2 is ahead of a negative edge time point of the third sequential scan signal B-SC3, the negative edge time point of the third sequential scan signal B-SC3 is ahead of a negative edge time point of the fourth sequential scan signal B-SC4, . . . , a negative edge time point of the n-th sequential scan signal B-SCn is ahead of a negative edge time point of the (n+1)-th sequential scan signal B-SCn+1, . . . , a negative edge time point of an (i−2)-th sequential scan signal B-SCi−2 is ahead of a negative edge time point of the (i−1)-th sequential scan signal B-SCi−1, and the negative edge time point of the (i−1)-th sequential scan signal B-SCi−1 is ahead of a negative edge time point of the i-th sequential scan signal B-SCi.

In multiple embodiments, each of the sequential scan signals B-SC1 to B-SCi may maintain the inactive voltage for remaining periods except each corresponding horizontal period.

In the example embodiment, "i" number of pixels (first to i-th pixels) are connected in common to an m-th data line DLm. The first to i-th pixels are individually connected to the first to i-th scan lines SL1 to SLi, respectively. One of the "i" number of pixels is an n-th pixel PXn.

In multiple, embodiments, a first data signal Vdata1 corresponding to a first pixel is applied to the m-th data line DLm in the first horizontal period, a second data signal Vdata2 corresponding to a second pixel is applied to the m-th data line DLm in the second horizontal period, a third data signal Vdata3 corresponding to a third pixel is applied to the m-th data line DLm in the third horizontal period, . . . , an n-th data signal Vdatan corresponding to an n-th pixel is applied to the m-th data line DLm in the n-th horizontal period, . . . , an (i−1)-th data signal Vdatai−1 corresponding to an (i−1)-th pixel is applied to the m-th data line DLm in the (i−1)-th horizontal period, and an i-th data signal Vdatai corresponding to an i-th pixel is applied to the m-th data line DLm in the i-th horizontal period.

In multiple embodiments, the first driving signal ELVDD may have voltages having different levels based on the above-described periods. For example, the first driving signal ELVDD maintains a third level voltage ELVDD_H (hereinafter, "a third driving voltage") in the first and seventh periods ① and ⑦, maintains a first level voltage ELVDD_L (hereinafter, "a first driving voltage") in the second period ②, and maintains a second level voltage ELVDD_M (hereinafter, "a second driving voltage") in the third, fourth, fifth and sixth periods ③, ④, ⑤ and ⑥.

The first driving voltage ELVDD_L, the second driving voltage ELVDD_M and the third driving voltage ELVDD_H have different levels. For example, the second driving voltage ELVDD_M may be greater than the first driving voltage ELVDD_L, and the third driving voltage ELVDD_H may be greater than the second driving voltage ELVDD_M. As a more specific example, the first driving voltage ELVDD_L may have a voltage level of about −5 V, the second driving voltage ELVDD_M may have a voltage level of about 1 V, and the third driving voltage ELVDD_H may have a voltage level of about 7 V.

In multiple embodiments, the second driving signal ELVSS may be a DC voltage having a constant voltage regardless of the period. For example, the second driving signal ELVSS may be a DC voltage less than or substantially equal to the first driving voltage ELVDD_L. As a more specific example, the second driving signal ELVSS may be a DC voltage having a voltage level of about 0 V.

In one embodiment, the second driving voltage ELVDD_M described above may be greater than or substantially equal to the second driving signal ELVSS and may be less than or substantially equal to a threshold voltage of a light emitting element LED.

In multiple embodiments, an initialization signal Vinit, a dummy signal Vdm and data signals Vdata1 to Vdatai are applied to the m-th data line DLm.

The initialization signal Vinit is applied to the m-th data line DLm in at least a part of the first period ①, at least a part of the second period ②, at least a part of the third period ③ and at least a part of the seventh period ⑦. For example, the initialization signal Vinit is applied to the m-th data line DLm in the first period ①, the second period ②, the third period ③ and the seventh period ⑦.

The initialization signal Vinit may have a level substantially equal to that of the second driving signal ELVSS. For example, the initialization signal Vinit may have a value of about 0 V.

The dummy signal Vdm is applied to the m-th data line DLm in at least a part of the fourth period ④. For example, the dummy signal Vdm may be applied to the m-th data line DLm in the fourth period ④. The dummy signal Vdm may have a level less than that of the initialization signal Vinit. For example, the dummy signal Vdm may have a level which is obtained by subtracting a kickback voltage from the initialization signal Vinit. In such an embodiment, the kickback voltage means a voltage change amount of a first node N1 (see FIG. 3) when the sequential scan signal transitions from the active voltage to the inactive voltage.

In addition, the aforementioned dummy signal Vdm may be applied to the m-th data line DLm in the sixth period ⑥. Alternatively, an initialization signal, instead of the dummy signal Vdm, may be applied to the m-th data line in the sixth period ⑥.

The data signals Vdata1 to Vdatai are sequentially applied to the m-th data line DLm in the fifth period ⑤. For example, the "i" number of data signals Vdatai to Vdatai may be sequentially applied to the m-th data line DLm in synchronization with the "i" number of sequential scan signals B-SC1 to B-SCi, respectively. Each of the "i" number of data signals Vdata1 to Vdatai may have a value greater than or less than the aforementioned initialization signal Vinit. For example, each of the "i" number of data signals Vdata1 to Vdatai may be a positive polarity data signal having a value greater than that of the initialization signal Vinit or a negative polarity data signal having a value less than that of the initialization signal Vinit.

Hereinafter, a detailed configuration of one of the pixels illustrated in FIG. 1 will be described with reference to FIG. 3.

Figure 3:
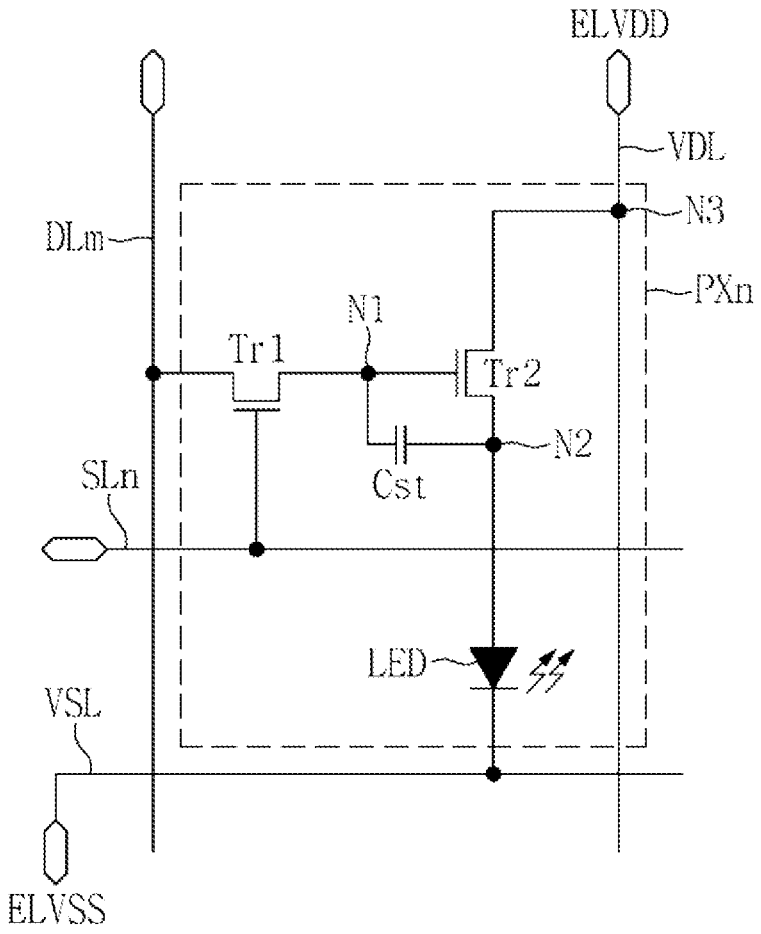
FIG. 3 is a view illustrating a circuit configuration of one of the pixels of FIG. 1.

FIG. 3 is a view illustrating a circuit configuration of one of the pixels of FIG. 1 according to multiple embodiments of the present invention.

For example, the n-th pixel PXn may include a first switch Tr1, a second switch Tr2, a storage capacitor Cst and the light emitting element LED, as illustrated in FIG. 3.

In the depicted example embodiment, the first switch Tr1 includes a gate electrode connected to the n-th scan line SLn and is connected between the m-th data line DLm and the first node N1. One of a drain electrode and a source electrode of the first switch Tr1 is connected to the m-th data line DLm and the other of the drain electrode and the source electrode of the first switch Tr1 is connected to the first node N1. For example, the drain electrode of the first switch Tr1 is connected to the m-th data line DLm, and the source electrode of the first switch Tr1 is connected to the first node N1. As used herein, m is a natural number.

The second switch Tr2 includes a gate electrode connected to the first node N1 and is connected between the first driving power line VDL and an anode electrode of the light emitting element LED. One of a drain electrode and a source electrode of the second switch Tr2 is connected to the first driving power line VDL and the other of the drain electrode and the source electrode of the second switch Tr2 is connected to a second node N2. For example, the drain electrode of the second switch Tr2 is connected to the first driving power line VDL through a third node N3 and the source electrode of the second switch Tr2 is connected to the second node N2.

The second switch Tr2 adjusts a magnitude of a driving current flowing from the first driving power line VDL to the second driving power line VSL according to a magnitude of a signal applied to the gate electrode of the second switch Tr2.

The storage capacitor Cst is connected between the first node N1 and the second node N2. The storage capacitor Cst stores the signal applied to the gate electrode of the second switch Tr2 for one frame period.

The light emitting element LED is connected between the second node N2 and the second driving power line VSL. The anode electrode of the light emitting element LED is connected to the second node N2, and a cathode electrode thereof is connected to the second driving power line VSL. The light emitting diode LED may be an organic light emitting diode. The light emitting element LED emits light in accordance with the driving current applied through the second switch Tr2. The light emitting element LED emits light of different brightness depending on the magnitude of the driving current.

The light emitting element LED of the red pixel is a red light emitting element LED that emits a red light, the light emitting element LED of the green pixel is a green light emitting element LED that emits a green light, and the light emitting element LED of the blue pixel is a blue light emitting element LED that emits a blue light.

Figure 4:
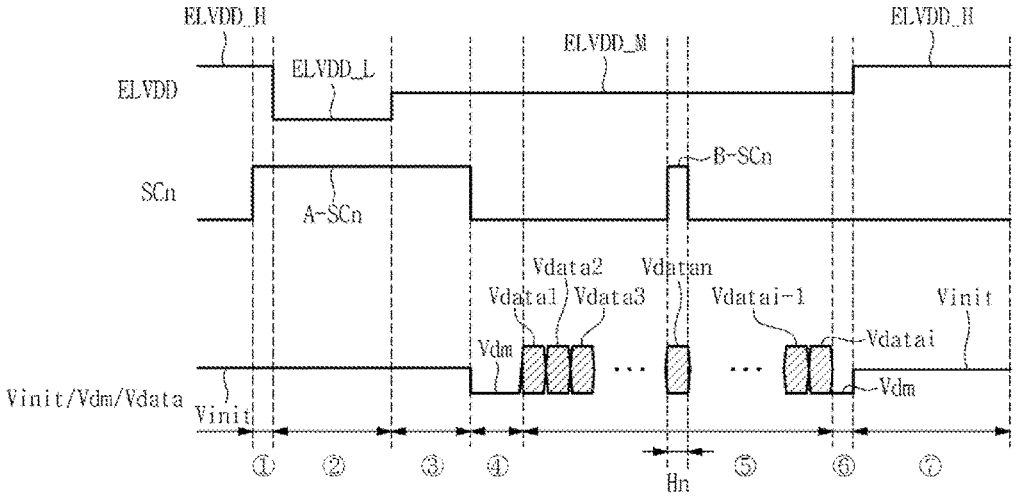
FIG. 4 is a diagram illustrating waveforms of a signal applied to an n-th scan line and a signal applied to the m-th data line of FIG. 3.

FIG. 4 is a diagram illustrating waveforms of a signal applied to the n-th scan line and a signal applied to the m-th data line of FIG. 3, and FIGS. 5A, 5B, 5C, 5D, 5E, 5F and 5G are explanatory views illustrating an operation of the n-th pixel in each period of FIG. 4 according to various embodiments of the present invention.

In FIGS. 5A, 5B, 5C, 5D, 5E, 5F and 5G, a switch which is enclosed by a circular dotted line of the first and second switches Tr1 and Tr2 is a turned-on switch and a switch which is depicted in dotted line is a turned-off switch.

The n-th pixel PXn operates as follows in the first period ①, the second period ②, the third period ③, the fourth period ④, the fifth period ⑤, the sixth period ⑥ and the seventh period ⑦.

1) First Period ①

First, the operation of the n-th pixel PXn in the first period ① will be described with reference to FIGS. 4 and 5A. The first period ① is a first initialization period, and gate voltages of the entire pixels including the n-th pixel PXn are concurrently initialized in the first period ①.

In the first period ①, as illustrated in FIG. 4, the n-th concurrent scan signal A-SCn maintains the active voltage (e.g., the high voltage). In addition, in the first period ①, the first driving signal ELVDD is maintained at the third driving voltage ELVDD_H. In addition, the initialization signal Vinit is applied to the m-th data line DLm in the first period ①.

Figure 5A:
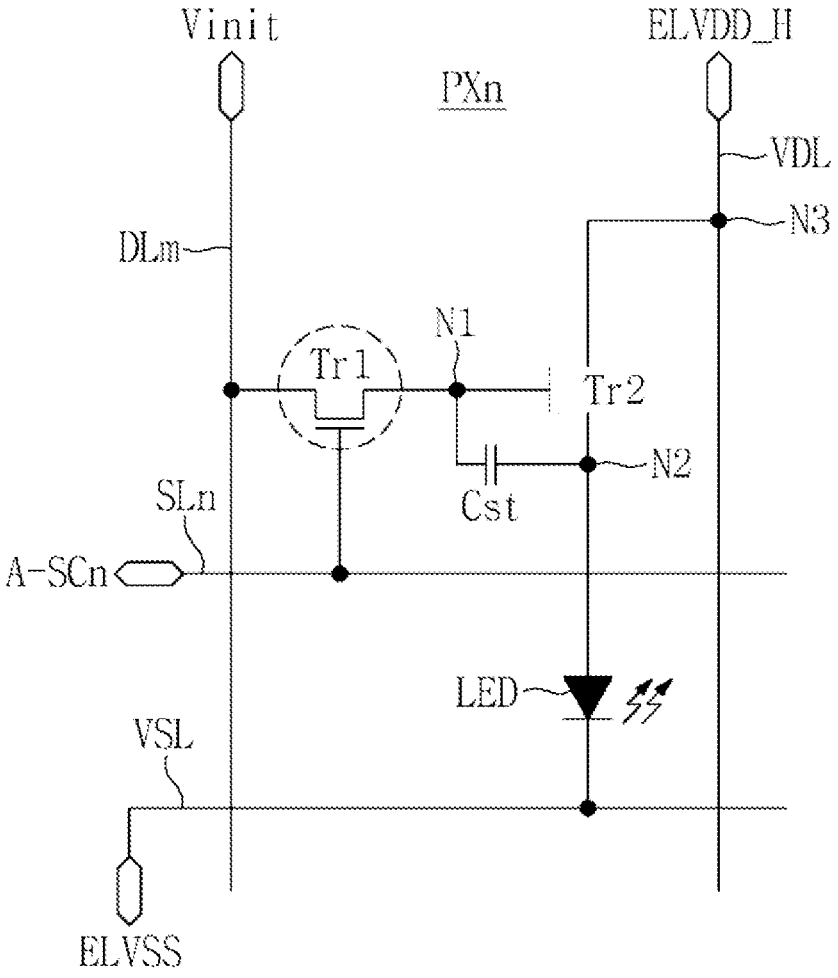
FIGS. 5A, 5B, 5C, 5D, 5E, 5F and 5G are explanatory views illustrating an operation of an n-th pixel in each period of FIG. 4.

Then, as illustrated in FIG. 5A, the first switch Tr1 is turned on by the n-th concurrent scan signal A-SCn having the active voltage. Then, the initialization signal Vinit is applied to the first node N1 through the turned-on first switch Tr1. That is, the initialization signal Vinit is applied to the gate electrode of the second switch Tr2. In an example embodiment, in this first period ①, each of the third driving voltage ELVDD_H and the voltage of second node N2 is greater than the voltage of the gate electrode of the second switch Tr2. Accordingly, a gate-source voltage Vgs of the second switch Tr2 has a value less than that of a threshold voltage Vth of the second switch Tr2. In such an example, the gate-source voltage Vgs of the second switch Tr2 is a difference voltage between the gate electrode and the source electrode of the second switch Tr2. In FIG. 5A, the gate electrode of the second switch Tr2 corresponds to the first node N1, and the source electrode of the second switch Tr2 corresponds to the second node N2.

As described above, because the gate-source voltage Vgs of the second switch Tr2 has a value less than that of the threshold voltage Vth of the second switch Tr2, the second switch Tr2 is turned off in the first period ①.

As the second switch Tr2 is turned off, the second node N2 electrically floats. In such an example, as the voltage of the first node N1 decreases due to the initialization signal Vinit, the voltage of the floating second node N2 decreases as well due to a coupling phenomenon of the storage capacitor Cst.

As such, the gate voltage of the second switch Tr2 is initialized to the initialization signal Vinit in the first period ①. In other words, the voltage of the first node N1 is initialized to the initialization signal Vinit.

In one embodiment, as a voltage across opposite ends of the light emitting element LED (the voltage of the anode electrode—the voltage of the cathode electrode) is less than the threshold voltage of the light emitting element LED in the first period ①, the light emitting element LED maintains an off state in the first period ①.

2) Second Period (②)

Next, the operation of the n-th pixel PXn in the second period ② will be described with reference to FIGS. 4 and 5B. The second period ② is a second initialization period. In the second period ②, drain voltages and source voltages of the entire pixels including the n-th pixel PXn are concurrently initialized.

In the second period ②, as illustrated in FIG. 4, the n-th concurrent scan signal A-SCn maintains the active voltage (e.g., the high voltage). In addition, in the second period ②, the first driving signal ELVDD is maintained at the first driving voltage ELVDD_L. In addition, the initialization signal Vinit is applied to the m-th data line DLm in the second period ②.

Figure 5B:
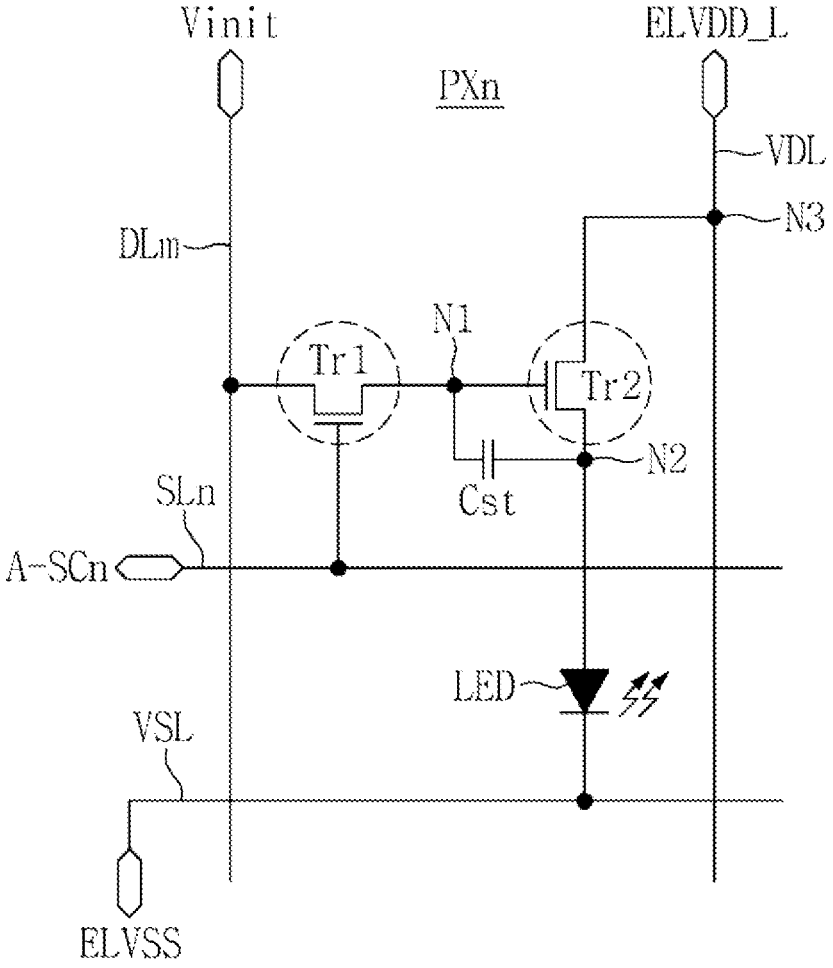

Then, as illustrated in FIG. 5B, the first switch Tr1 maintains the turned-on state by the n-th concurrent scan signal A-SCn having the active voltage. Then, the initialization signal Vinit is applied to the first node N1 through the turned-on first switch Tr1. That is, the initialization signal Vinit is applied to the gate electrode of the second switch Tr2. In an example embodiment, because the first driving signal ELVDD falls from the third driving voltage ELVDD_H to the first driving voltage ELVDD_L in the second period ②, the gate-source voltage Vgs of the second switch Tr2 has a value greater than that of the threshold voltage Vth of the second switch Tr2. In such an example, the gate-source voltage Vgs of the second switch Tr2 is a difference voltage between the gate electrode and the source electrode of the second switch Tr2. In FIG. 5B, the gate electrode of the second switch Tr2 corresponds to the first node N1, and the source electrode of the second switch Tr2 corresponds to the third node N3.

As described above, because the gate-source voltage Vgs of the second switch Tr2 has a value greater than that of the threshold voltage Vth of the second switch Tr2, the second switch Tr2 is turned on. The first driving voltage ELVDD_L is applied to the second node N2 through the turned-on second switch Tr2. Accordingly, in the second period ②, each of the source voltage and the drain voltage of the second switch Tr2 is initialized to the first driving voltage ELVDD_L. In other words, each of the voltage of the second node N2 and the voltage of the third node N3 is initialized to the first driving voltage ELVDD_L.

Accordingly, the gate voltage, the source voltage and the drain voltage of the second drive switch Tr2 are initialized through the first period ① and the second period ②.

In one embodiment, as a voltage across opposite ends of the light emitting element LED (the voltage of the anode electrode—the voltage of the cathode electrode) is less than the threshold voltage of the light emitting element LED, the light emitting element LED maintains an off state in the second period ②.

3) Third Period (③)

Next, the operation of the n-th pixel PXn in the third period ③ will be described with reference to FIGS. 4 and 5C. The third period ③ is a threshold voltage detection period and threshold voltages Vth of the entire pixels including the n-th pixel PXn are concurrently detected in the third period ③.

In the third period ③, as illustrated in FIG. 4, the n-th concurrent scan signal A-SCn maintains the active voltage (e.g., the high voltage). In addition, in the third period ③, the first driving signal ELVDD is maintained at the second driving voltage ELVDD_M. In addition, the initialization signal Vinit is applied to the m-th data line DLm in the third period ③.

Figure 5C:
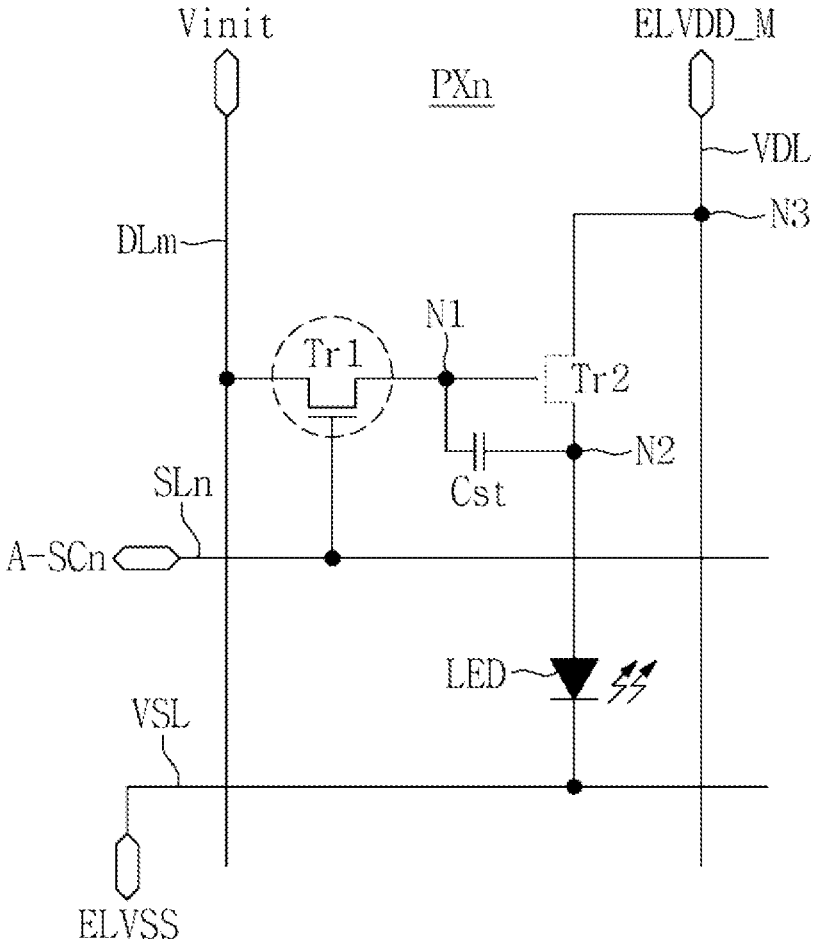

Then, as illustrated in FIG. 5C, the first switch Tr1 maintains the turned-on state by the n-th concurrent scan signal A-SCn having the active voltage. Then, the initialization signal Vinit is applied to the first node N1 through the turned-on first switch Tr1. That is, the initialization signal Vinit is applied to the gate electrode of the second switch Tr2. In an example embodiment, as the first driving signal ELVDD rises from the first driving voltage ELVDD_L to the second driving voltage ELVDD_M in the third period ③, electric charges of the second node N2 are discharged to the third node N3 through the turned-on second switch Tr2. Accordingly, the voltage of the second node N2 gradually rises. As the voltage of the second node N2 rises, the gate-source voltage Vgs of the second switch Tr2 decreases. In such an embodiment, the gate-source voltage Vgs of the second switch Tr2 is a difference voltage between the gate electrode and the source electrode of the second switch Tr2. In FIG. 5C, the gate electrode of the second switch Tr2 corresponds to the first node N1, and the source electrode of the second switch Tr2 corresponds to the second node N2.

The second switch Tr2 is turned off when the gate-source voltage Vgs of the second switch Tr2 decreases and becomes substantially equal to the threshold voltage Vth of the second switch Tr2. In an example embodiment, the threshold voltage Vth of the second switch Tr2 is stored in the second node N2. For example, the voltage of the second node N2 is a voltage Vinit-Vth obtained by subtracting the threshold voltage Vth from the initialization signal Vinit. In addition, the voltage Vinit-Vth is substantially equal to a voltage ELVDD_M-Vth obtained by subtracting the threshold voltage Vth of the second switch Tr2 from the second driving voltage ELVDD_M.

As such, the threshold voltage Vth of the second switch Tr2 is detected and stored in the second node N2, in the third period ③.

In one embodiment, as a voltage across opposite ends of the light emitting element LED (the voltage of the anode electrode—the voltage of the cathode electrode) is less than the threshold voltage of the light emitting element LED, the light emitting element LED maintains an off state in the third period ③.

4) Fourth Period ④

Next, the operation of the n-th pixel PXn in the fourth period ④ will be described with reference to FIGS. 4 and 5D. The fourth period ④ is a first dummy period. In the fourth period ④, the dummy signal Vdm is applied to the entire data lines including the m-th data line DLm.

In the fourth period ④, as illustrated in FIG. 4, the n-th concurrent scan signal A-SCn maintains the inactive voltage (e.g., the low voltage). In addition, in the fourth period ④, the first driving signal ELVDD is maintained at the second driving voltage ELVDD_M. In addition, the dummy signal Vdm is applied to the m-th data line DLm in the fourth period ④.

Figure 5D:
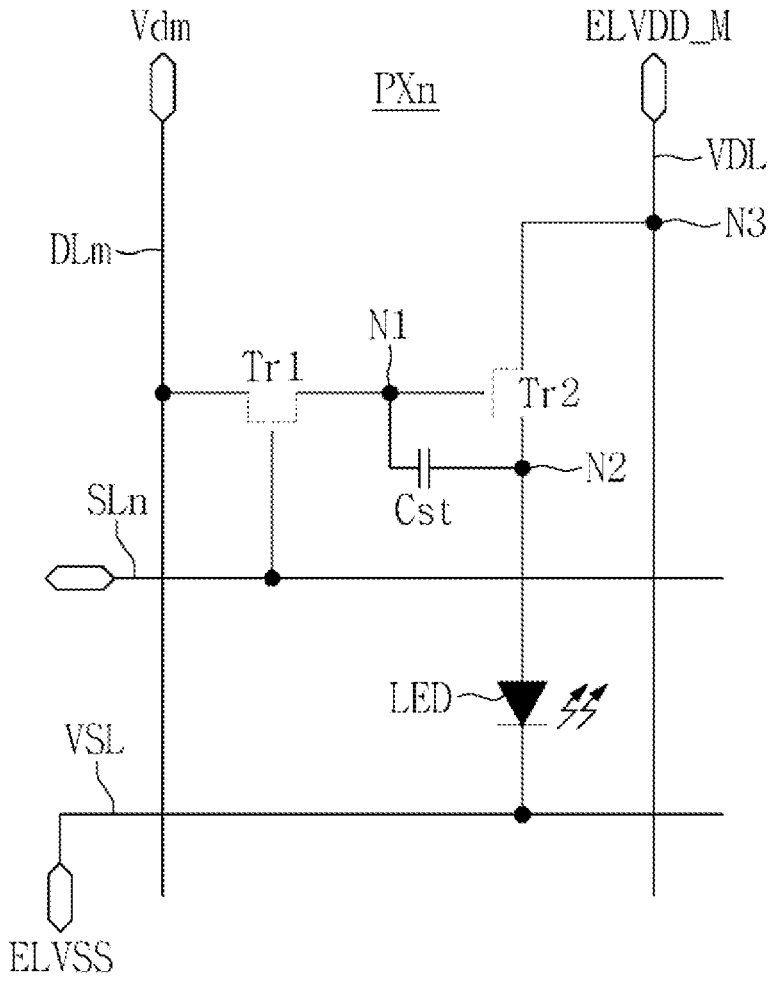

Then, as illustrated in FIG. 5D, the first switch Tr1 is turned off by the n-th concurrent scan signal A-SCn having the inactive voltage.

In an example embodiment, as the dummy signal Vdm is input to the m-th data line DLm in the fourth period ④, the voltage of the source electrode of the first switch Tr1 is lowered.

As the n-th concurrent scan signal A-SCn falls from the active voltage to the inactive voltage in the fourth period ④, the voltage of the first node N1 decreases in synchronization with the n-th concurrent scan signal A-SCn. That is, when the first switch Tr1 is turned off by the n-th scan signal SCn having the inactive voltage, the first node N1 electrically floats. Because the n-th concurrent scan signal A-SCn falls from the active voltage to the inactive voltage, the voltage of the floating first node N1 decreases along with the n-th concurrent scan signal A-SCn due to a coupling phenomenon of a parasitic capacitor of the first switch Tr1. A leakage current may be generated from the first switch Tr1. That is, the first switch Tr1 is turned on, and electric charges of the first node N1 may be discharged through the turned-on first switch Tr1. The dummy signal Vdm is applied to the m-th data line DLm in the fourth period ④ so as to substantially prevent the leakage current of the first switch Tr1. The dummy signal Vdm has a voltage value less than that of the initialization signal Vinit.

In various embodiments, because the voltage of the first node N1 decreases in the fourth period ④, the voltage of the second node decreases in synchronization with the voltage of the first node N1. For example, because the voltage of the first node N1 decreases, the voltage of the floating second node N2 decreases as well due to a coupling phenomenon of the storage capacitor Cst.

In one embodiment, as a voltage across opposite ends of the light emitting element LED (the voltage of the anode electrode—the voltage of the cathode electrode) is less than the threshold voltage of the light emitting element LED in the fourth period ④, the light emitting element LED maintains an off state in the fourth period ④.

5) Fifth Period ⑤

Next, the operation of the n-th pixel PXn in the fifth period ⑤ will be described below with reference to FIG. 4 and FIG. 5E. The fifth period ⑤ is a data writing period. In the fifth period ⑤, the first to i-th data signals are sequentially applied to the m-th data line DLm. The fifth period ⑤ includes the first to i-th horizontal periods as described above, and the operation of the n-th pixel PXn in the n-th horizontal period Hn of the fifth period ⑤ will be described below.

In the n-th horizontal period Hn, as illustrated in FIG. 4, the n-th sequential scan signal B-SCn maintains the active voltage (e.g., the high voltage). In addition, in the n-th horizontal period Hn, the first driving signal ELVDD is maintained at the second driving voltage ELVDD_M. In addition, the n-th data signal Vdatan is applied to the m-th data line DLm in the n-th horizontal period Hn. In this example, the n-th data signal Vdatan is a data signal corresponding to the n-th pixel PXn.

Figure 5E:
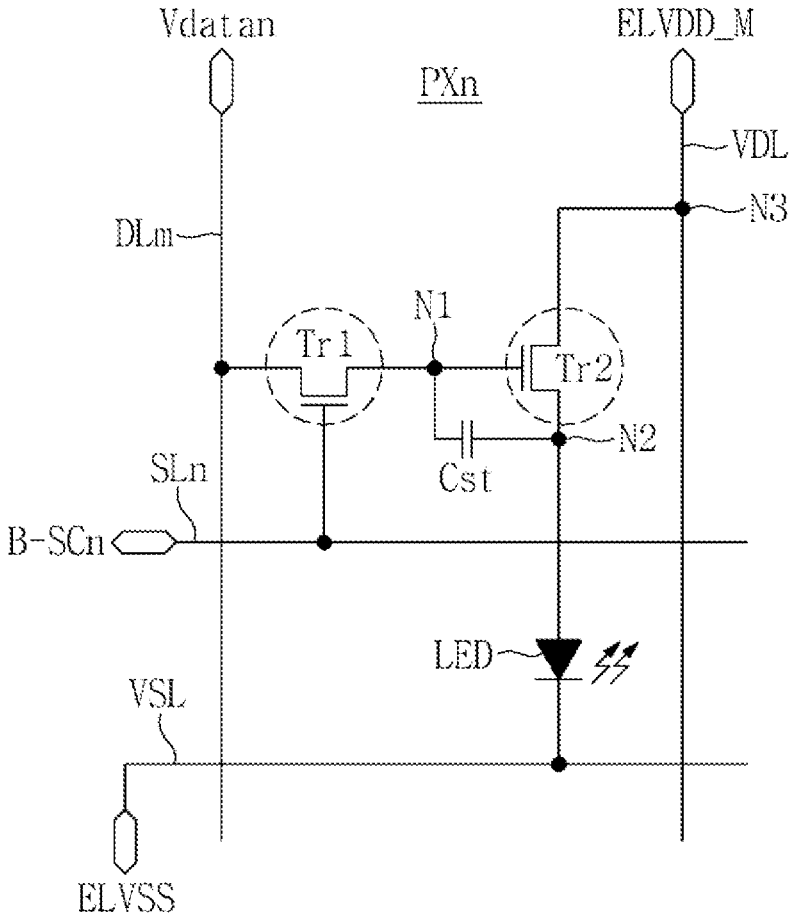

Then, as illustrated in FIG. 5E, the first switch Tr1 maintains the turned-on state by the n-th sequential scan signal B-SCn having the active voltage. Then, the n-th data signal Vdatan is applied to the first node N1 through the turned-on first switch Tr1. That is, the n-th data signal Vdatan is applied to the gate electrode of the second switch Tr2. Then, the gate voltage of the second switch Tr2 rises. Because the gate voltage rises, the voltage of the floating second node N2 rises as well due to a coupling phenomenon of the storage capacitor Cst. As the voltage of the second node N2 is divided by a parasitic capacitor of the light emitting element LED, an amount of the voltage increase of the second node N2 is less than an amount of the voltage increase of the first node N1. Accordingly, the gate-source voltage Vgs of the second switch Tr2 is greater than the threshold voltage Vth of the second switch Tr2 in the n-th horizontal period Hn. The gate-source voltage Vgs of the second switch Tr2 is a difference voltage between the gate electrode and the source electrode of the second switch Tr2. In FIG. 5E, the gate electrode of the second switch Tr2 corresponds to the first node N1, and the source electrode of the second switch Tr2 corresponds to the second node N2.

As described above, because the gate-source voltage Vgs of the second switch Tr2 has a value greater than that of the threshold voltage Vth of the second switch Tr2, the second switch Tr2 is turned on. The voltage of the second node N2 rises through the turned-on second switch Tr2. That is, the voltage of the second node N2 starts to rise toward the second driving voltage ELVDD_M.

In this example, because the n-th sequential scan signal B-SCn decreases to the inactive voltage at an end time point of the n-th horizontal period Hn, the first switch Tr1 is turned off. Because the first switch Tr1 is turned off, the first node N1 electrically floats. Because the second switch Tr2 is not yet turned off even in the state where the first node N1 floats, the voltage of the second node N2 continuously rises at the end time point of the n-th horizontal period Hn. Because the voltage of the second node N2 rises, the voltage of the floating first node N1 rises as well due to a coupling phenomenon of the storage capacitor Cst. Accordingly, the second switch Tr2 maintains the turned-on state for a certain period of time from the end time point of the n-th horizontal period Hn. The voltage of the second node N2 therefore rises. When the voltage of the second node N2 rises to be substantially equal to the second driving voltage ELVDD_M, the second switch Tr2 is turned off because the gate-source voltage Vgs of the second switch Tr2 becomes less than the threshold voltage Vth of the second switch Tr2. Accordingly, the threshold voltage Vth of the second switch Tr2 is reflected to the first node N1 from the end time point of the n-th horizontal period Hn until the second switch Tr2 is turned off.

When the second switch Tr2 is turned off after the end time point of the n-th horizontal period Hn, the voltage V_N1 of the first node N1 is obtained by the following Equation 1.

$$V_N1=(1-(CCst/(CCel+CCst))*Vdatan+ELVDDD_M+Vth \quad \text{Equation 1}$$

In Equation 1, V_N1 denotes the voltage of the first node, CCst denotes a capacitance of the storage capacitor Cst, and CCel denotes a capacitance of the parasitic capacitor of the light emitting element LED.

Because the voltage across opposite ends of the light emitting element LED (the voltage of the anode electrode—the voltage of the cathode electrode) is less than the threshold voltage of the light emitting element LED in the fifth period the light emitting element LED maintains an off state in the fifth period ⑥.

6) Sixth Period ⑥

Figure 5F:
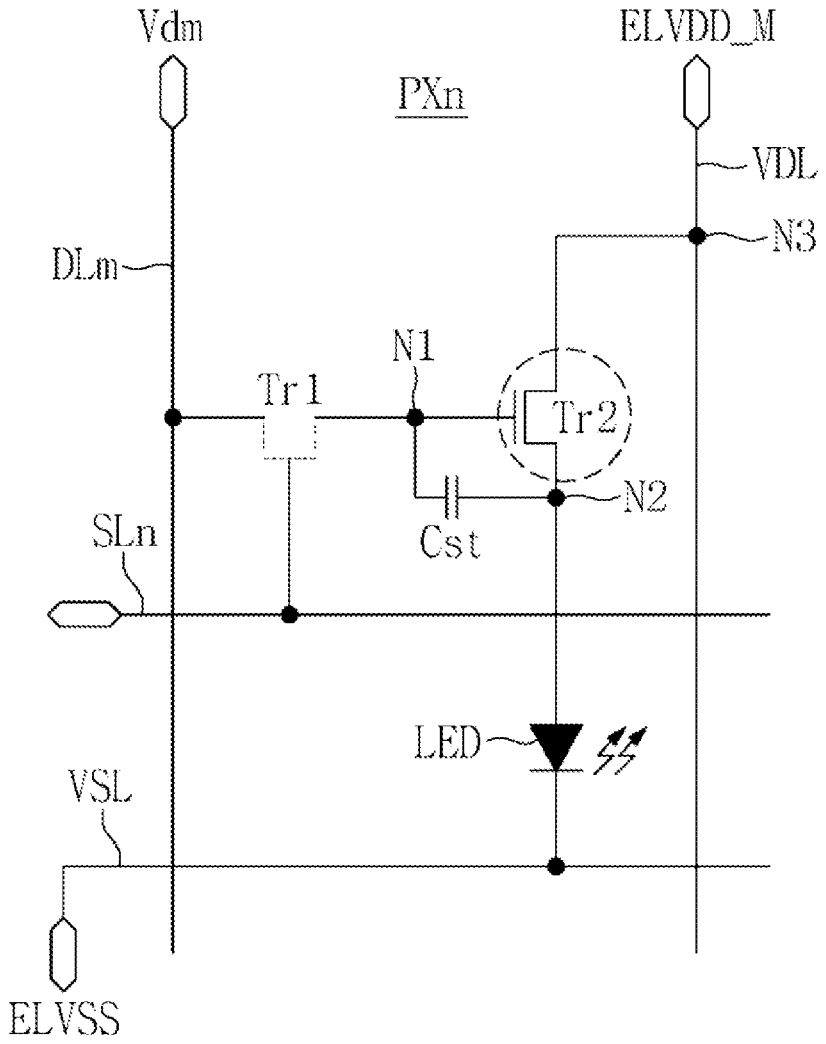

Hereinafter, the operation of the n-th pixel PXn in the sixth period ⑥ will be described with reference to FIGS. 4 and 5F. The sixth period ⑥ is a second dummy period and the dummy signal Vdm is applied to the entire data lines including the m-th data line DLm in the sixth period ⑥.

In the sixth period ⑥, as illustrated in FIG. 4, the n-th scan signal SCn maintains the inactive voltage (e.g., the low voltage). In addition, in the sixth period ⑥, the first driving signal ELVDD is maintained at the second driving voltage ELVDD_M. In addition, the dummy signal Vdm is applied to the m-th data line DLm in the sixth period ⑥.

The sixth period ⑥ is located between the fifth period ⑤ and the seventh period ⑦. In the sixth period ⑥, the threshold voltage of the second switch is reflected to the first node of the i-th pixel connected to a last scan line, i.e., the i-th scan line. In other words, the sixth period ⑥ is a spare period required to reflect the threshold voltage of the second switch included in the i-th pixel which is a last pixel of the pixels connected to the m-th data line DLm to the first node of the i-th pixel.

Because the voltage across opposite ends of the light emitting element LED (the voltage of the anode electrode—the voltage of the cathode electrode) is less than the threshold voltage of the light emitting element LED in the sixth period ⑥, the light emitting element LED maintains an off state in the sixth period ⑥.

7) Seventh Period ⑦

Figure 5G:
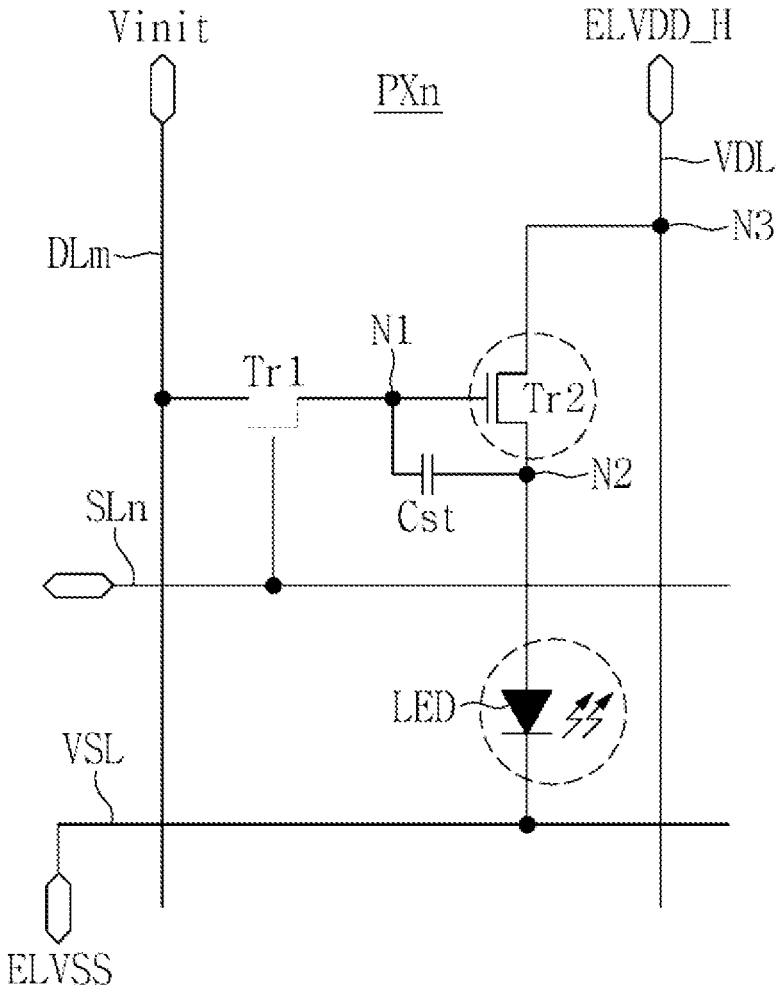

Next, the operation of the n-th pixel PXn in the seventh period ⑦ will be described with reference to FIGS. 4 and 5G. The seventh period ⑦ is a light emission period. In the seventh period ⑦, the entire pixels including the n-th pixel PXn emit light concurrently.

In the seventh period ⑦, as illustrated in FIG. 4, the n-th sequential scan signal B-SCn maintains the inactive voltage (e.g., the low voltage). In addition, in the seventh period ⑦, the first driving signal ELVDD is maintained at the third driving voltage ELVDD_H. In addition, the initialization signal Vinit is applied to the m-th data line DLm in the seventh period ⑦.

As the first driving signal ELVDD rises from the second driving voltage ELVDD_M to the third driving voltage ELVDD_H, the third driving voltage ELVDD_H is applied to the second node N2 through the turned-on second switch Tr2. That is, the voltage of the second node N2 rises to the third driving voltage ELVDD_H. In this example, because the voltage of the second node N2 rises, the voltage of the floating first node N1 rises as well due to a coupling phenomenon of the storage capacitor Cst. Accordingly, the gate-source voltage Vgs of the second switch Tr2 is greater than the threshold voltage Vth of the second switch in the seventh period ⑦. The gate-source voltage Vgs of the second switch Tr2 is a difference voltage between the gate electrode and the source electrode of the second switch Tr2. In FIG. 5G, the gate electrode of the second switch Tr2 corresponds to the first node N1, and the source electrode of the second switch Tr2 corresponds to the second node N2.

In addition, as described above, because the voltage of the second node N2 rises, the difference voltage between the anode voltage and the cathode voltage of the light emitting element LED becomes greater than the threshold voltage of the light emitting element LED. Accordingly, the light emitting element LED is turned on, and the driving current flows through the turned-on light emitting element LED. The light emitting element LED emits light by the driving current. A luminance of the turned-on light emitting element LED is determined depending on the magnitude of the driving current, and the magnitude of the driving current is obtained by the following Equation 2.

Equation 2

$$\begin{aligned} Iel &= K^*(Vgs - Vth)^2 = K^*(\mathrm{V_N1} - \mathrm{V_N2} - Vth)^2 \\ &= K^*((1 - (CCst/(CCel + CCst))^* Vdatan + \mathrm{ELVDDD_M} + Vth) - \\ &\quad \mathrm{ELVDD_M} - Vth)^2 \\ &= K^*((1 - (CCst/(CCel + CCst))^* Vdatan)^2 \end{aligned}$$

In Equation 2, Iel denotes the driving current flowing through the light emitting device LED, and K denotes a constant.

Referring to Equation 2, it is appreciated that the magnitude of the driving current Iel is not affected by the threshold voltage Vth of the second switch Tr2. Accordingly, despite of the magnitude variation of the threshold voltage Vth of the second switch Tr2, each pixel PX may generate a driving current of a substantially equal magnitude with respect to an equal data signal.

Figure 6:
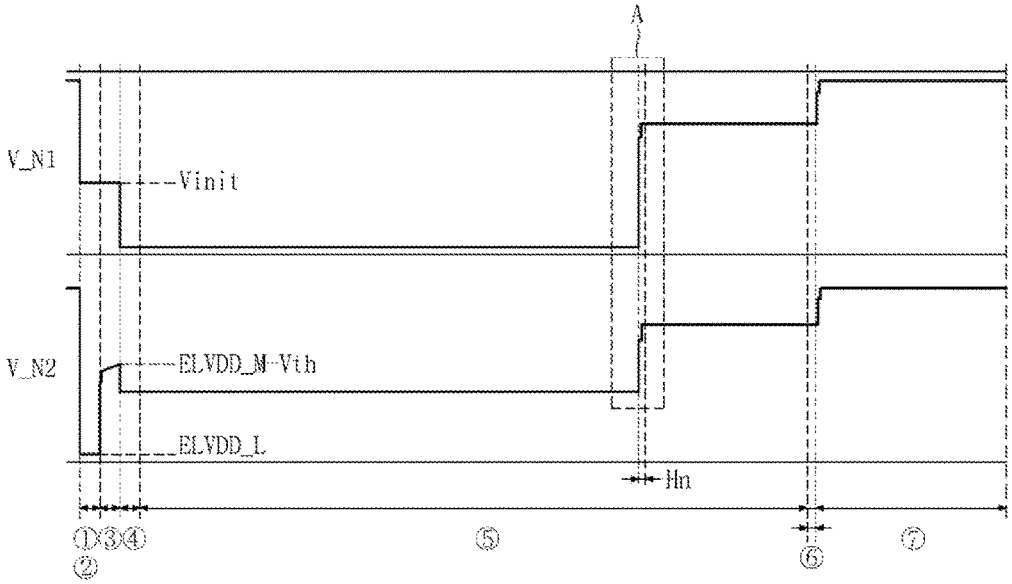
FIG. 6 is a graph illustrating a voltage of a first node and a voltage of a second node in each period from the results of a simulation of the circuit of FIG. 3 with the signal of FIG. 4 applied.
Figure 7:
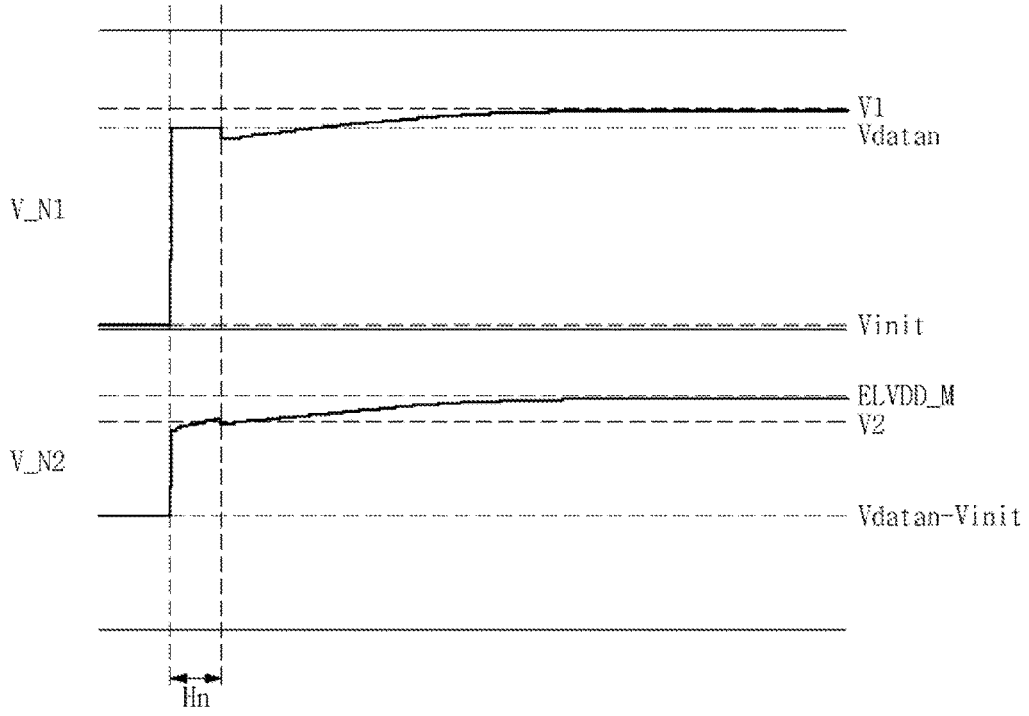
FIG. 7 is a graph illustrating an enlarged view of portion A of FIG. 6.

FIG. 6 is a graph illustrating voltages of a first node and a second node in each period from the results of a simulation in which the circuit of FIG. 3 and the signal of FIG. 4 are applied, and FIG. 7 is an enlarged view illustrating a portion A of FIG. 6.

FIG. 6 includes a top graph illustrating the voltage of the first node N1 for each period, and a bottom graph illustrating the voltage of the second node N2 for each period. In the top graph of FIG. 6, an X-axis represents the first, second, third, fourth, fifth, sixth and seventh periods, and a Y-axis represents the voltage of the first node. In the bottom graph of FIG. 6, an X-axis represents the first, second, third, fourth, fifth, sixth and seventh periods, and a Y-axis represents the voltage of the second node.

As illustrated in FIG. 6, the voltage of the first node N1 is initialized to the initialization signal Vinit in the first period ①. In FIG. 6, because the first period ① is considerably shorter than the second period ②, the first period ① and the second period ② appear as one period.

As illustrated in FIG. 6, the voltage of the second node N2 in the second period ② is initialized to the first driving voltage ELVDD_L.

In the example embodiment illustrated in FIG. 6, the threshold voltage Vth of the second switch Tr2 is stored in the second node N2 in the third period ③. For example, the voltage of the second node N2 is a voltage Vinit-Vth obtained by subtracting the threshold voltage Vth from the initialization signal Vinit. The voltage Vinit-Vth is substantially equal to a voltage ELVDD_M-Vth which is obtained by subtracting the threshold voltage Vth of the second switch Tr2 from the second driving voltage ELVDD_M.

As illustrated in FIG. 6, because the n-th concurrent scan signal A-SCn falls from the active voltage to the inactive voltage in the fourth period ④, the voltage of the floating first node N1 decreases as well due to a coupling phenomenon of a parasitic capacitor of the first switch Tr1. In addition, as the voltage of the first node N1 decreases, the voltage of the floating second node N2 decreases as well due to a coupling phenomenon of the storage capacitor Cst.

As illustrated in FIG. 7, the n-th data signal Vdatan is applied to the first node N1 in the n-th horizontal period Hn. As the n-th sequential scan signal B-SCn falls from the active voltage to the inactive voltage at an end time point of the n-th horizontal period Hn, the voltage of the floating first node N1 decreases as well due to the coupling phenomenon of the parasitic capacitor of the first switch Tr1. In addition, as the voltage of the first node N1 decreases, the voltage of the second node N2 decreases as well due to the coupling phenomenon of the storage capacitor Cst. The voltage of the second node N2 rises after the end time point of the n-th horizontal period Hn until the second switch Tr2 is turned off, and the voltage of the first node N1 rises as well due to the coupling phenomenon of the storage capacitor Cst.

When the second switch TTr2 is turned off, the voltage V1 of the first node is obtained by the following Equation 3.

$$V1 = (1 - (CCst/(CCel + CCst))^* Vdatan + ELVDDD_M + Vth \qquad \text{Equation 3}$$

When the second switch Tr2 is turned off, the voltage V2 of the second node is substantially equal to the second driving voltage ELVDD_M.

Figure 8:
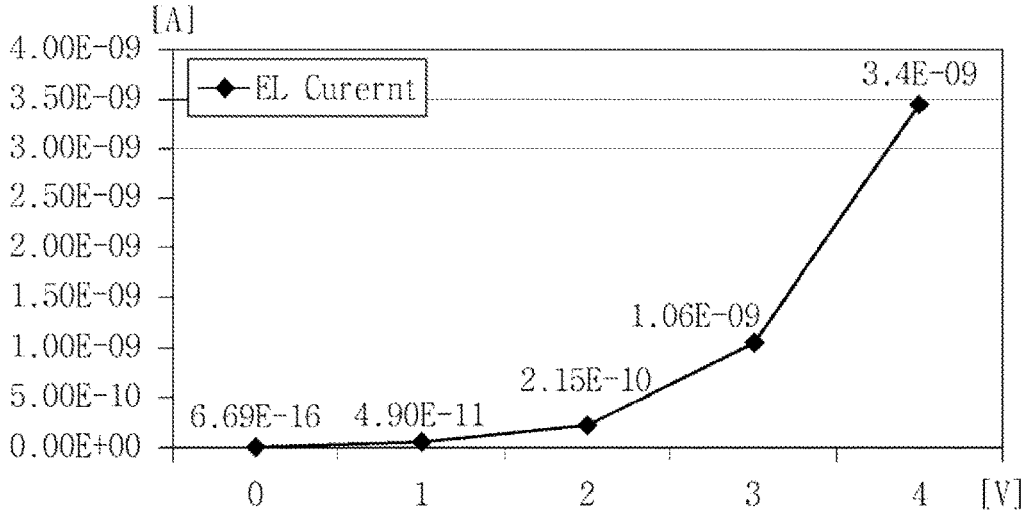
FIG. 8 is a graph illustrating a driving current dependent on a data signal from the results of a simulation in which the circuit of FIG. 3 has the signal of FIG. 4 applied.

FIG. 8 is a graph illustrating a driving current depending on a data signal from the results of a simulation in which the circuit of FIG. 3 and the signal of FIG. 4 are applied according to various embodiments of the present invention.

In FIG. 8, an X-axis represents a data signal, and a Y-axis represents a driving current (herein, EL current) flowing through the light emitting element LED.

In FIG. 8, a data signal of about 0 V is a data signal of a black gray scale, and a data signal of about 4 V is a data signal of a white gray scale.

Referring to FIG. 8, it may be appreciated that the driving current of a normal magnitude is generated corresponding to each gray scale from the black gray scale to the white gray scale.

Figure 9:
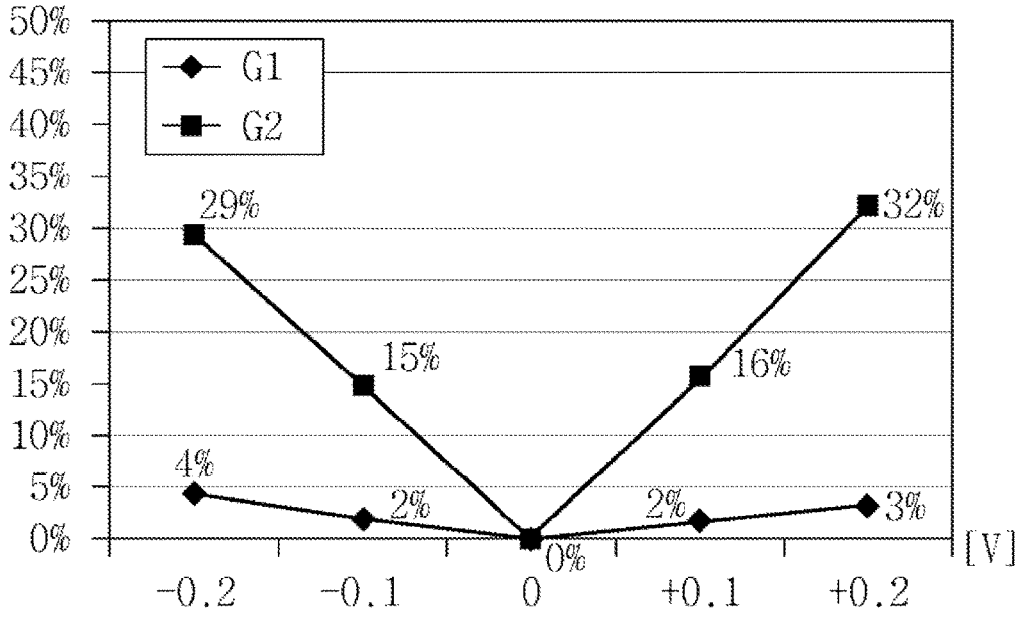
FIG. 9 is a graph illustrating an error rate of a driving current depending on a change amount of a threshold voltage from the results of a simulation of the circuit of FIG. 3 having the signal of FIG. 4 applied.

FIG. 9 is a graph illustrating an error rate of a driving current depending on a change amount of a threshold voltage from the results of a simulation in which the circuit of FIG. 3 and the signal of FIG. 4 are applied according to various embodiments of the present invention.

In FIG. 9, an X-axis represents a variation amount of the threshold voltage Vth of the second switch Tr2, and a Y-axis represents an error rate of the driving current flowing through the light emitting element LED.

In FIG. 9, a first graph G1 shows the error rate of the driving current depending on the variation amount of the threshold voltage Vth measured from an example embodiment of the present invention, and a second graph G2 shows an error rate of a driving current depending on a variation amount of a threshold voltage measured from a conventional art.

Referring to FIG. 9, it may be appreciated that the error rate of an example embodiment is less than the error rate of a conventional art.

Figure 10:
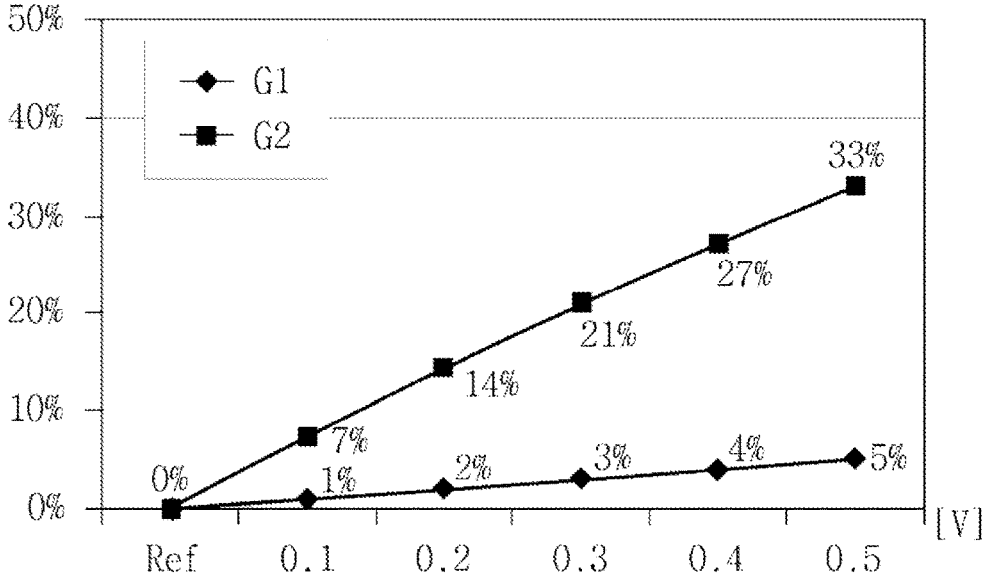
FIG. 10 is a graph illustrating an error rate of a driving current depending on an IR-drop from the results of a simulation in which the circuit of FIG. 3 has the signal of FIG. 4 applied.

FIG. 10 is a graph illustrating an error rate of a driving current depending on an IR-drop from the results of a simulation in which the circuit of FIG. 3 and the signal of FIG. 4 are applied according to various embodiments of the present invention.

In FIG. 10, an X-axis represents an IR drop of the second driving signal ELVSS, and a Y-axis represents an error rate of the driving current flowing through the light emitting element LED.

In FIG. 10, a first graph G1 shows the error rate of the driving current according to a variation amount of the IR-drop of the second driving signal ELVSS measured from an example embodiment of the present invention, and a second graph G2 shows an error rate of a driving current according to a variation amount of an IR-drop measured from a conventional art.

Referring to FIG. 10, the error rate according to an example embodiment is less than that of the conventional art.

Figure 11:
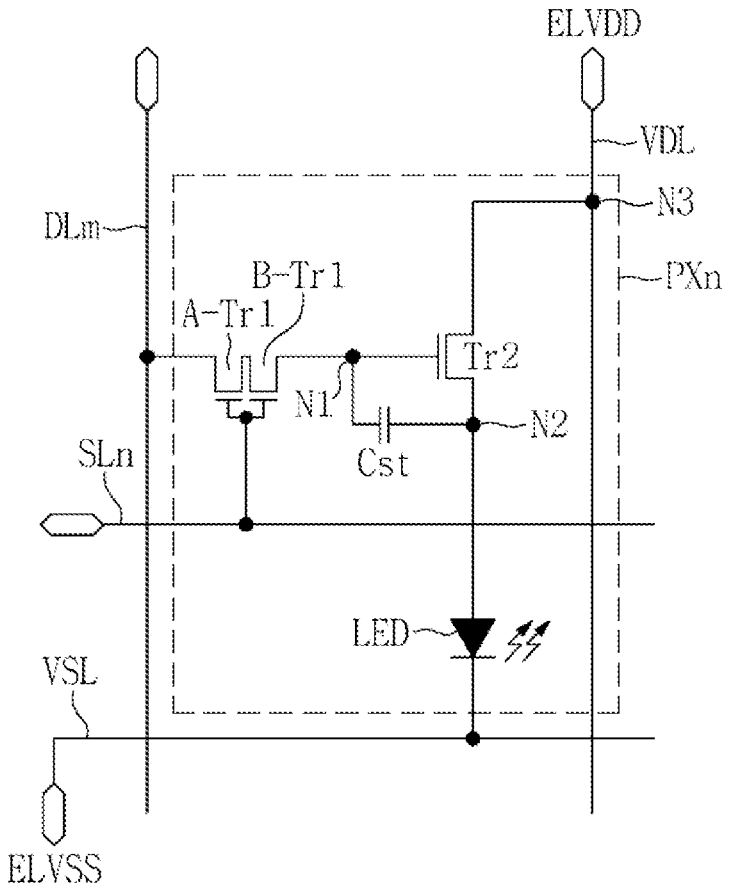
FIG. 11 is a view illustrating a circuit configuration of one pixel of FIG. 1 according to an alternative embodiment.

FIG. 11 is a view illustrating a circuit configuration in one pixel of FIG. 1 according to an alternative example embodiment.

As illustrated in FIG. 11, an n-th pixel PXn may include a first switch Tr1, a second switch Tr2, a storage capacitor Cst and a light emitting element LED.

The first switch Tr1 includes a gate electrode connected to an n-th scan line SLn and is connected between an m-th data line DLm and a first node N1. In this example embodiment, the first switch Tr1 may include at least two switches connected in series between the m-th data line DLm and the first node N1. For example, the first switch Tr1 may include a first A-switch A-Tr1 and a first B-switch B-Tr1.

The first A-switch A-Tr1 includes a gate electrode connected to the n-th scan line SLn and is connected between the m-th data line DLm and the first B-switch B-Tr1.

The first B-switch B-Tr1 includes a gate electrode connected to the n-th scan line SLn and is connected between the first A-switch A-Tr1 and the first node N1.

The second switch Tr2, the storage capacitor Cst and the light emitting element LED of FIG. 11 are substantially identical to the second switch Tr2, the storage capacitor Cst and the light emitting element LED of FIG. 2, respectively.

Figure 12:
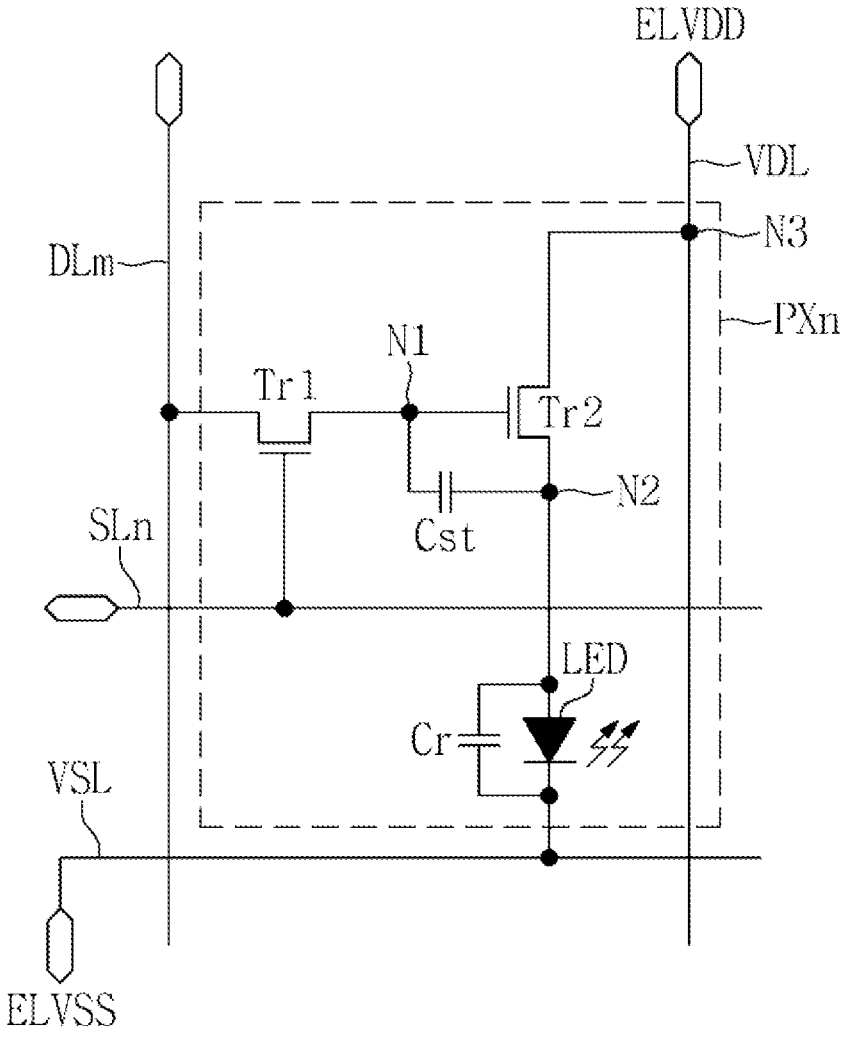
FIG. 12 is a view illustrating a circuit configuration of one pixel of FIG. 1 according to another alternative embodiment.

FIG. 12 is a view illustrating a circuit configuration in one pixel of FIG. 1 according to another alternative example embodiment.

As illustrated in FIG. 12, an n-th pixel PXn may include a first switch Tr1, a second switch Tr2, a first capacitor Cst, a second capacitor Cr and a light emitting element LED.

The second capacitor Cr is connected between a second node N2 and a second driving power line VSL. In this example embodiment, the second capacitor Cr is connected in parallel to the light emitting element LED.

The first switch Tr1, the second switch Tr2, the first capacitor Cst and the light emitting element LED of FIG. 12 are substantially identical to the first switch Tr1, the second switch Tr2, the storage capacitor Cst and the light emitting element LED of FIG. 2, respectively.

Figure 13:
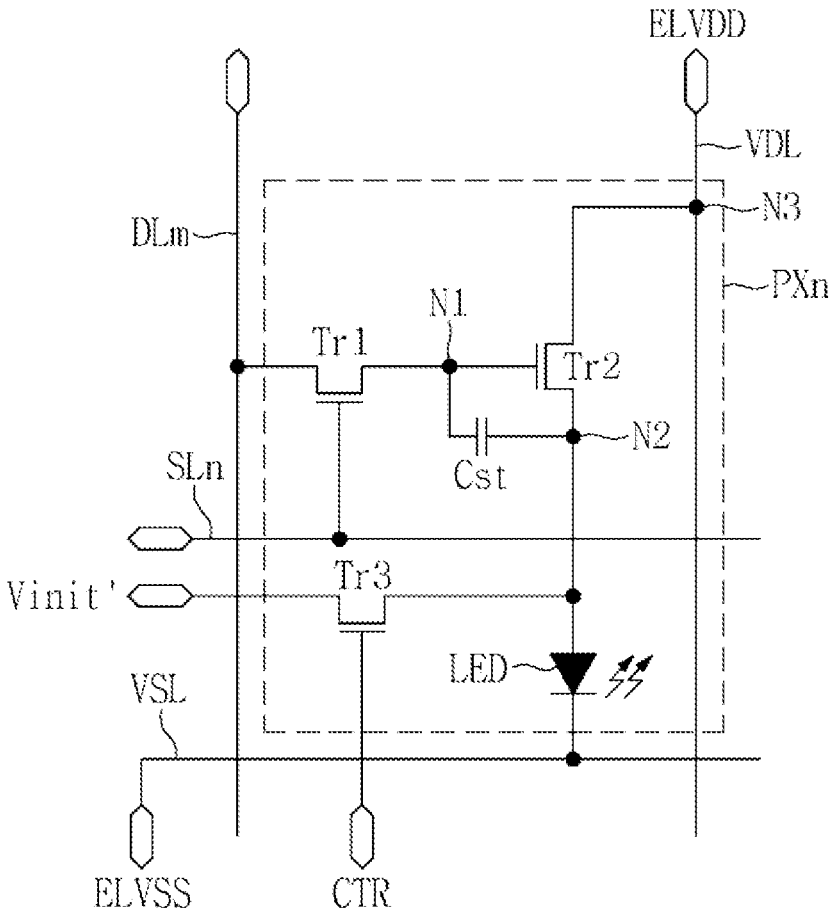
FIG. 13 is a view illustrating a circuit configuration of one pixel of FIG. 1 according to another alternative embodiment.
Figure 14:
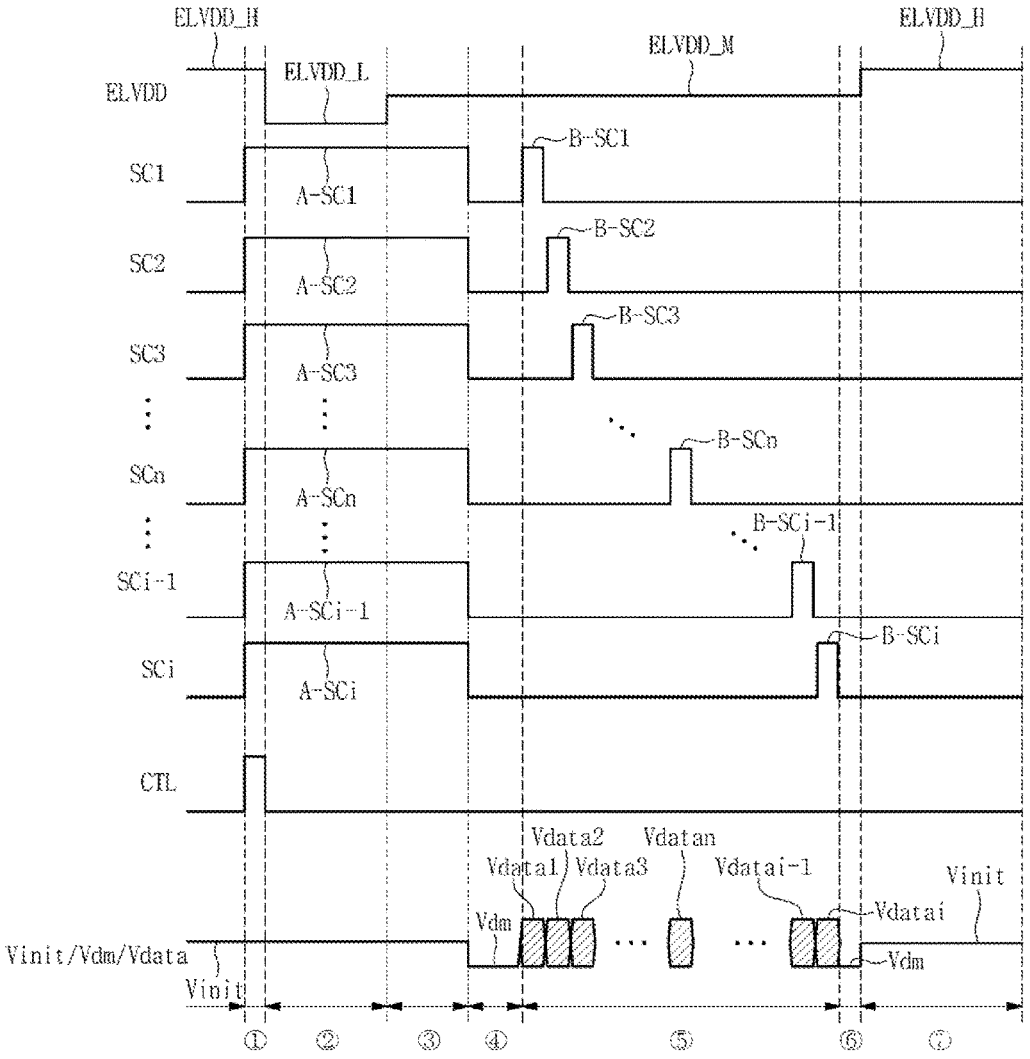
FIG. 14 is a diagram illustrating a control signal applied to a third switch of FIG. 13.

FIG. 13 is a view illustrating a circuit configuration in one pixel of FIG. 1 according to another alternative example embodiment, and FIG. 14 is an explanatory graph illustrating a control signal applied to a third switch.

As illustrated in FIG. 13, an n-th pixel PXn may include a first switch Tr1, a second switch Tr2, a third switch Tr3, a storage capacitor Cst and a light emitting element LED.

The third switch Tr3 includes a gate electrode to which a control signal CTL is applied, and is connected between a second node N2 and an initialization line IL to which an initialization signal Vinit' is applied. One of a drain electrode and a source electrode of the third switch Tr3 is connected to the initialization line IL and the other of the drain electrode and the source electrode of the third switch Tr3 is connected to the second node N2. For example, the drain electrode of the third switch Tr3 is connected to the second node N2, and the source electrode of the third switch Tr3 is connected to the initialization line IL.

The control signal CTL may be output from a scan driver 151. In the case where all pixels PX have a configuration illustrated in FIG. 8, the third switch Tr3 of each pixel PX may receive the control signal CTL in common.

The initialization signal Vinit' is a DC voltage. This initialization signal Vinit' may be substantially equal to the initialization signal Vinit applied to the m-th data line DLm described above. The initialization signal Vinit' may be output from a power supply portion 123 or a data driver 153.

The control signal CTL may be applied to the gate electrode of the third switch Tr3 in at least a part of a first period ①. The control signal CTL may have an active voltage for at least a part of the first period ①. For example, as illustrated in FIG. 14, the control signal CTL may maintain the active voltage in the first period ①.

The first switch Tr1, the second switch Tr2, the storage capacitor Cst and the light emitting element LED of FIG. 13 are substantially identical to the first switch Tr1, the second switch Tr2, the storage capacitor Cst and the light emitting element LED of FIG. 2.

As set forth hereinabove, according to one or more example embodiments, the light emitting display device may provide the following effects.

First, because one pixel includes two switches and one storage capacitor, the size of the pixel may be reduced.

Second, because the number of elements included in the pixel is relatively small, the number of lines connected to the elements may be reduced. That is, one pixel is connected to the scan line, the data line, the first driving power line and the second driving power line.

Third, because the data signal is applied to the first node through a switch, a gray scale range of the data signal may be reduced.

Fourth, because a circuit of the pixel has a source follower structure, an IR-drop of the first driving signal may be substantially minimized when the light emitting element emits light.

Fifth, the entire pixels emit light concurrently in the light emission period (the seventh period). Accordingly, the light emitting display device according to one or more example embodiments may be applied to a head mounted display.

Sixth, because the number of capacitors is relatively small, a capacitance between the data line and the first and second nodes may be substantially minimized.

Seventh, because the gate voltage of the second switch is initialized in the initialization period, a datum of a current frame is not affected by a data signal of a previous frame.

Eighth, because the first driving signal and the second driving power are applied in common to the entire pixels of the display panel, no separate power driver is required.

Ninth, because the first driving signal is changed to driving voltages having different levels corresponding to each period, the leakage current of the second switch may be substantially minimized. That is, because the first driving signal maintains the level of the second driving voltage in the third, fourth, fifth and sixth periods, a difference voltage between the source electrode and the drain electrode of the second switch may be kept relatively small in these periods. Accordingly, the leakage current from the second switch of each pixel may be substantially minimized in these periods. Thus, a gradation phenomenon may be substantially minimized at a relatively low gray scale.

Tenth, because the second driving signal is a DC signal, power consumption is substantially minimized.

While the present invention has been illustrated and described with reference to the example embodiments thereof, it will be apparent to those of ordinary skill in the art that various changes in form and detail may be formed thereto without departing from the spirit and scope of the present invention.

What is claimed is:

1. A light emitting display device comprising:

a first switch comprising a gate electrode connected to a first scan line, the first switch connected between a data line and a first node;

a second switch comprising a gate electrode connected to the first node, the second switch connected between a first driving power line and a second node;

a first capacitor connected between the first node and the second node;

a light emitting element connected between the second node and a second driving power line;

a scan driver configured to apply a first A-scan signal to the first scan line in at least a part of first, second and third periods among a consecutive first period, the second period, the third period, a fourth period, a fifth period, a sixth period and a seventh period, and to apply a first B-scan signal to the first scan line in a part of the fifth period;

a data driver configured to apply a first initialization signal to the data line in at least a part of the first, second and third periods, and to apply a data signal to the data line in a part of the fifth period; and a power supply portion configured to apply a first driving voltage to the first driving power line in at least a part of the second period, applying a second driving voltage, which is greater than the first driving voltage, to the first driving power line in at least a part of the third, fourth, fifth and sixth periods, and applying a third driving voltage, which is greater than the second driving voltage, to the first driving power line in at least a part of the first period and at least a part of the seventh period.

2. The light emitting display device of claim 1, wherein the first A-scan signal has an active voltage in the first, second and third periods, and the first B-scan signal has an active voltage in one horizontal period of the fifth period.

3. The light emitting display device of claim 1, further comprising a second scan line adjacent to the first scan line, wherein the scan driver is further configured to apply a second A-scan signal and a second B-scan signal to the second scan line, and the scan driver is configured to apply the second A-scan signal to the second scan line in at least a part of the first, second and third periods and to apply the second B-scan signal to the second scan line in at least a part of the fifth period.

4. The light emitting display device of claim 3, wherein the first A-scan signal and the second A-scan signal have an active voltage in the first, second and third periods, the first B-scan signal has an active voltage in a first horizontal period of the fifth period, and the second B-scan signal has an active voltage in a second horizontal period of the fifth period.

5. The light emitting display device of claim 4, wherein a positive edge time point of the first A-scan signal is substantially equal to a positive edge time point of the second A-scan signal, and a negative edge time point of the first A-scan signal is substantially equal to a negative edge time point of the second A-scan signal.

6. The light emitting display device of claim 4, wherein the first A-scan signal and the second A-scan signal have a substantially equal pulse width.

7. The light emitting display device of claim 4, wherein a positive edge time point of the first B-scan signal is ahead of a positive edge time point of the second B-scan signal, and a negative edge time point of the first B-scan signal is ahead of a negative edge time point of the second B-scan signal.

8. The light emitting display device of claim 4, wherein the first B-scan signal and the second B-scan signal have a substantially equal pulse width.

9. The light emitting display device of claim 1, wherein the first switch comprises at least two switches connected in series between the data line and the first node.

10. The light emitting display device of claim 1, further comprising a second capacitor connected between the second node and the second driving power line.

11. The light emitting display device of claim 1, further comprising a third switch comprising a gate electrode to which configured to receive a control signal, the third switch connected between the second node and an initialization line configured to receive a second initialization signal.

12. The light emitting display device of claim 11, wherein the power supply portion is configured to apply the second initialization signal.

13. The light emitting display device of claim 11, wherein the control signal has an active voltage in at least a part of the first period.

14. The light emitting display device of claim 11, wherein the second initialization signal and the first initialization signal have a substantially equal voltage.

15. The light emitting display device of claim 1, wherein the power supply portion is configured to apply a fourth driving voltage to the second driving power line.

16. The light emitting display device of claim 15, wherein the fourth driving voltage is less than or equal to the first driving voltage.

17. The light emitting display device of claim 1, wherein the data driver is further configured to apply a first initialization signal to the data line in at least a part of the seventh period.

* * * * *